US005238780A

United States Patent [19]

Takagi et al.

[11] Patent Number: 5,238,780

[45] Date of Patent: Aug. 24, 1993

[54] METHOD OF IMAGE FORMATION

[75] Inventors: Yoshihiro Takagi; Kazunobu Katoh, both of Kanagawa, Japan

[73] Assignee: Fuji Photo Film Co., Ltd., Kanagawa, Japan

[21] Appl. No.: 757,354

[22] Filed: Sep. 10, 1991

[30] Foreign Application Priority Data

Sep. 13, 1990 [JP] Japan ..... 2-242983

[51] Int. Cl.[5] ..... G03C 1/06

[52] U.S. Cl. ..... 430/264; 430/267; 430/449; 430/517; 430/598

[58] Field of Search ..... 430/264, 598, 517, 267, 430/449

[56] References Cited

U.S. PATENT DOCUMENTS 5,085,971 2/1992 Katoh et al. ..... 430/598

5,139,921 8/1992 Takagi et al. ..... 430/264

*Primary Examiner*—Charles L. Bowers, Jr.

*Assistant Examiner*—Geraldine Letscher

*Attorney, Agent, or Firm*—Sughrue, Mion, Zinn, Macpeak & Seas

[57] ABSTRACT

A method for forming images having a contrast of greater than G 8, comprising the step of developing an imagewise exposed silver halide photographic material with a developing solution having a pH of 11.2 or less. The silver halide photographic material comprises a support having thereon a hydrophilic colloid layer containing a redox compound which releases a development inhibitor upon oxidation and at least one photosensitive silver halide emulsion layer containing a hydrazine derivative. The at least one photosensitive silver halide emulsion layer containing a hydrazine derivative is different from the hydrophilic colloid layer containing a redox compound.

10 Claims, No Drawings

METHOD OF IMAGE FORMATION

FIELD OF THE INVENTION

The present invention relates to a silver halide photographic material (particularly a negative type photographic material) used in the field of photoengraving, and the use of processing solutions of high stability to rapidly form supercontrast images.

BACKGROUND OF THE INVENTION

Various silver halides which form high contrast images are well known, and photographic image formation methods employing such silver halides are used in the field of photoengraving.

Special developing solutions known as lithographic developers were used in the prior art for this purpose. Lithographic developers contain hydroquinone as the developing agent; and sulfite as a preservative which does not inhibit infectious development. The sulfite is used in the form of a formaldehyde adduct, and the concentration of the released sulfite ion is very low (generally 0.1 mol/liter). As a result, lithographic developers are easily oxidized by atmospheric oxygen, and disadvantageously cannot be stored for more than 3 days.

Methods using hydrazine for obtaining high contrast photographic characteristics using stable developers are disclosed in U.S. Pat. Nos. 4,224,401, 4,168,977, 4,166,742, 4,311,781, 4,272,606, 4,211,857, and 4,243,739. Supercontrast high sensitivity photographic characteristics are obtained by the practice of these methods; furthermore, because these developers can tolerate a high concentration of sulfite, their stability against air oxidation is greatly increased in comparison with the lithographic developers.

Nevertheless, the above noted methods of forming supercontrast images using hydrazine compounds are characterized in that the infectious development progresses strongly. As a result, when photographing a low contrast character original (particularly the fine lines of Ming style type), portions which should have been fine white regions become blackened, the characters also become blackened and collapsed and cannot be deciphered. Because of this, if the exposure is reduced to provide better reproduction of the fine lines of the Ming type characters, Gothic type letters become blackened. Namely, the problem was that the latitude of exposure was narrow. A similar problem arises in photography of dot images, namely, blackening easily occurs up to the portion which is the white ground of the dot, and the dot gradation has the disadvantage of very defective image quality.

Due to the strongly infectious development characteristics of a hydrazine compound, the portions with low exposure or which are unexposed and are located adjacent to the exposed portions are as a result also developed. In order to inhibit this undesirable effect, a method of restraining image broadening due to infectious development, and a method for development (below micro development inhibition) to restrain the development of portions adjacent to the image portion, was desirable.

As a method of inhibiting infectious development, the quantity of nucleating agent may be reduced, and the pH of the developer may be lowered as disclosed in JP-A-1-179939 (corresponding to U.S. Ser. No. 295,671( (the term "JP-A" as used herein refers to a "published unexamined Japanese patent application"); however, the gradation becomes soft toned, and the degree of sharpness of image lines is lost.

The present invention controls the nucleating agent by adjusting the pH of the developer to 11.2 or less. A sufficient increase in contrast generally does not arise when the pH is less than 11.2, but sufficient gradation contrast may be obtained by the conjoint use of a nucleation promoter. In development at this pH, in comparison with development at a higher pH, the present inventors have discovered that the tendency to infectious development is weak, and image broadening is limited.

Furthermore, the development reaction in the image portion is invariably accompanied by the release of $H^+$ ions and halogen ions. The pH is reduced by the diffusion of $H^+$ ions to portions adjacent to the image, and micro development restraint of the portion adjacent to the image is caused by the diffusion of halogen ions, but it is recognized that this development is readily manifested in nucleation development at a pH below 11.2.

Image reproducibility is greatly increased by these various methods, as shown by JP-A-63-257658, but further improvement is desirable. Photosensitive materials containing redox compounds which, upon oxidation, release photographically useful groups are disclosed in JP-A-61-213847 and U.S. Pat. No. 4,684,604, and proposals for widening the processing window for obtaining good gradation are disclosed. In supercontrast processing systems in which hydrazine derivatives are used, these redox compounds have the disadvantageous effect of inhibiting greater contrast, such that optimum results are not obtained.

SUMMARY OF THE INVENTION

A primary object of the present invention is to provide a silver halide photographic material having good reproducibility of image lines and dots (wide exposure latitude).

A second object of the present invention is to provide a method of formation of high contrast images in systems using hydrazine compounds in a stable developer, the photographic performance of which remains stable.

The above described objects of the present invention are attained by providing a method for forming images having a contrast of greater than G 8 which comprises developing an imagewise exposed silver halide photographic material with a developing solution having a pH of 11.2 or less, said silver halide photographic material comprising a support having thereon a hydrophilic colloid layer containing a redox compound which releases a development inhibitor upon oxidation and at least one photosensitive silver halide emulsion layer containing at least one hydrazine derivative represented by formula (I), and said at least one photosensitive silver halide emulsion layer containing at least one hydrazine derivative represented by formula (I) being different from said hydrophilic colloid layer containing a redox compound:

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group, $R_2$ represents a hydrogen atom, an alkyl group, an aryl group, an alkoxy group, an aryloxy group, an amino group or a hydrazino group, $G_1$ represents a $$-\overset{\overset{\displaystyle O}{\|}}{C}-\text{ group,}$$

an $-SO_2$ group, an $-SO-$ group, $$\text{a } -\underset{\underset{\displaystyle R_2}{|}}{\overset{\overset{\displaystyle O}{\|}}{P}}-\text{ group, a } -\overset{\overset{\displaystyle O}{\|}}{C}-\overset{\overset{\displaystyle O}{\|}}{C}-\text{ group,}$$

a thiocarbonyl group, or an iminomethylene group, $A_1$ and $A_2$ each represents a hydrogen atom, or one of $A_1$ and $A_2$ represents a hydrogen atom and the other represents a substituted or unsubstituted alkylsulfonyl group, or a substituted or unsubstituted arylsulfonyl group, or a substituted or unsubstituted acyl group.

In a preferred embodiment, the present invention is directed to forming black-and-white images.

DETAILED DESCRIPTION OF THE INVENTION

In formula (I), the aliphatic group or aromatic group represented by $R_1$ has 1 to 30 carbon atoms, and preferably is a straight chain, branched or cyclic alkyl group having 1 to 20 carbon atoms. The alkyl group may be substituted.

The aromatic group represented by $R_1$ in formula (I) is a monocyclic or bicyclic aryl group or an unsaturated heterocyclic group. The unsaturated heterocyclic group may be fused with an aryl group. The term "heterocyclic group" as used herein means a 5- to 7-membered heterocyclic group containing 1 to 3 hetero atoms such as N, O, S and Se, unless otherwise indicated.

$R_1$ preferably is an aryl group, and one containing a benzene ring is particularly preferred.

The aliphatic group or aromatic group of $R_1$ may be substituted. Representative substituents include, for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or aryl-sulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carboxamide group, a sulfonamide group, a carboxyl group, a phosphoramide group, a diacylamino group, an imide group, or an $$R_2-NH\underset{\underset{\displaystyle R_2}{|}}{\overset{\overset{\displaystyle O}{\|}}{C}}N-\overset{\overset{\displaystyle O}{\|}}{C}-\text{ group;}$$

preferred substituents are an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group substituted with an alkyl group having 1 to 20 carbon atoms), an acylamino group (preferably having 2 to 30 carbon atoms), a sulfonamide group (preferably having 1 to 30 carbon atoms), a ureido group (preferably having 1 to 30 carbon atoms), or a phosphoramide group (preferably having 1 to 30 carbon atoms).

The alkyl group represented by $R_2$ in formula (I) is preferably an alkyl group having 1 to 4 carbon atoms; as the aryl group, a monocyclic or bicyclic aryl group is preferred (for example, one containing a benzene ring).

When $G_1$ is a $$-\overset{\overset{\displaystyle O}{\|}}{C}-\text{ group,}$$

the groups preferred among those represented by $R_2$ are a hydrogen atom, an alkyl group (for example, methyl, trifluoromethyl, 3-hydroxypropyl, 3-methanesulfonamidopropyl, phenylsulfonylmethyl), an aralkyl group (for example, o-hydroxybenzyl), an aryl group (for example, phenyl, 3,5-dichlorophenyl, o-methanesulfonamidophenyl, 4-methanesulfonylphenyl, 2-hydroxymethylphenyl), etc. A hydrogen atom is particularly preferred.

$R_2$ may be substituted. The substituent groups described above in relation to $R_1$ are suitable as substituent groups.

A $$-\overset{\overset{\displaystyle O}{\|}}{C}-\text{ group}$$

is most preferable as $G_1$ in formula (I).

Furthermore, with regard to $R_2$, the $-G_1-R_2$ portion may be split from the rest of the molecule, and a cyclic structure containing the atoms of the $-G_1-R_2$ portion may be formed by a cyclization reaction as disclosed, for example, in JP-A-63-29751.

Hydrogen atoms are most preferred for $A_1$ and $A_2$.

Ballast groups or polymers commonly used in couplers and the like passive photographic additives may be included in $R_1$ or $R_2$ of formula (I). The ballast groups are comparatively photographically inert groups having 8 or more carbon atoms, and can be selected from, for example, alkyl groups, alkoxy groups, phenyl groups, alkylphenyl groups, phenoxy groups, alkylphenoxy groups, etc. Furthermore, the polymer, for example, disclosed in JP-A-1-100530, is useful.

Groups which strengthen adsorption onto the surface of the silver halide grains may be included in $R_1$ or $R_2$ of formula (I). Useful adsorption promoting groups include thiourea groups, heterocyclic thioamide groups, mercapto heterocyclic groups, triazole groups, etc., as disclosed in U.S. Pat. Nos. 4,385,108 and 4,459,347, and in JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244 and JP-A-63-234246, and in Japanese Patent Application No. 62-67501.

Specific examples of the compound represented by formula (I) are shown below, but the present invention is not limited to the following compounds.

I-1
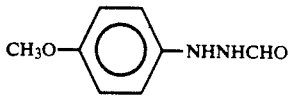
I-2
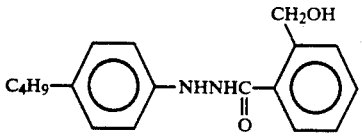
I-3
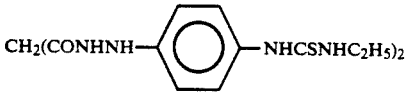
I-4
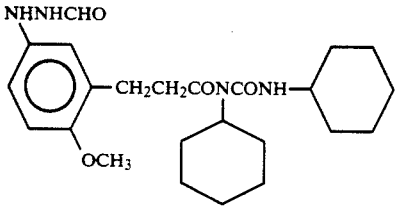
I-5
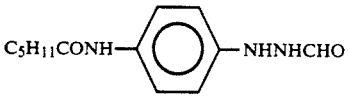
I-6
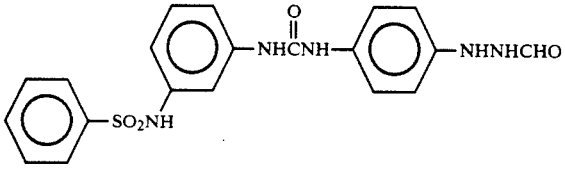
I-7
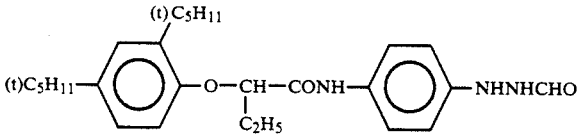
I-8
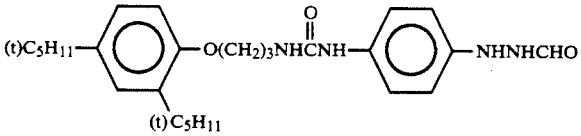
I-9
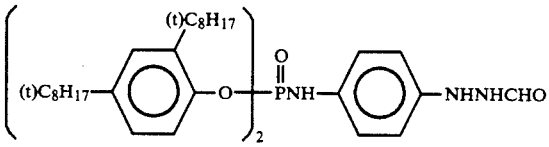
I-10
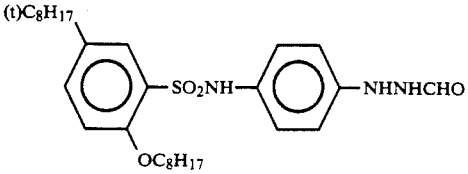

-continued
I-11
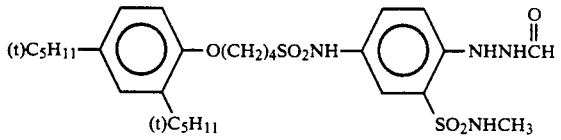
I-12
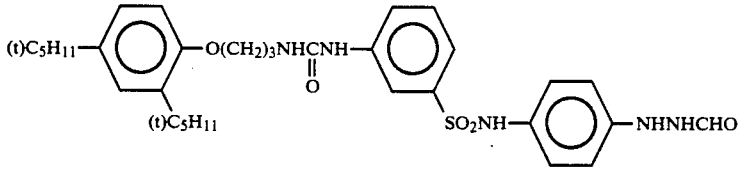
I-13
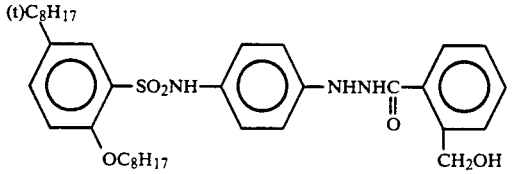
I-14
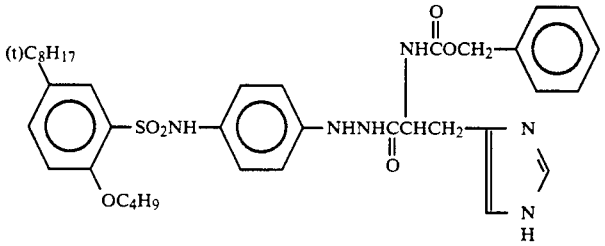
I-15
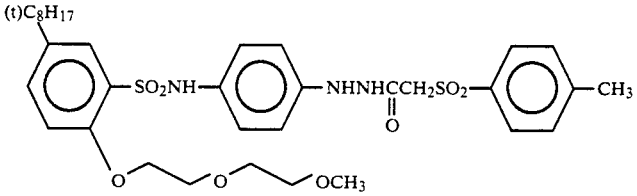
I-16
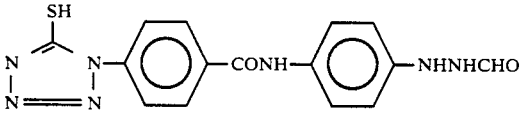
I-17
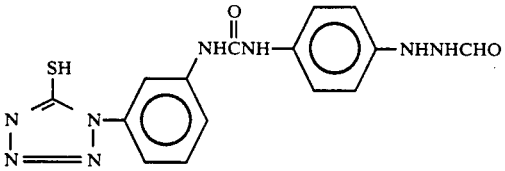
I-18
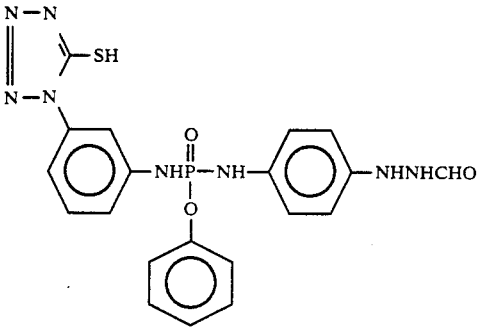

-continued
I-19
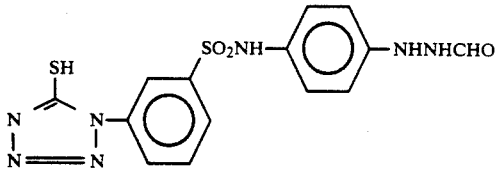
I-20
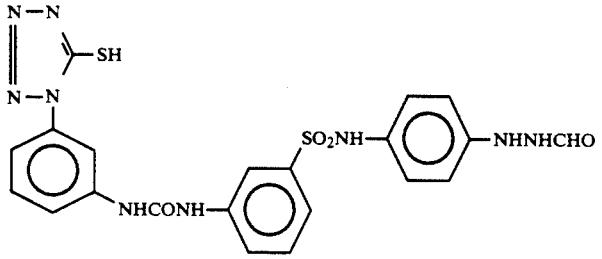
I-21
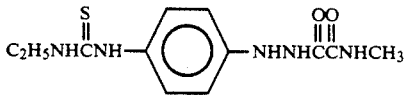
I-22
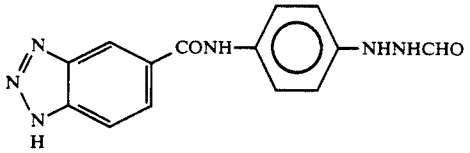
I-23
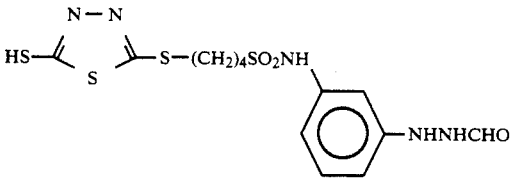
I-24
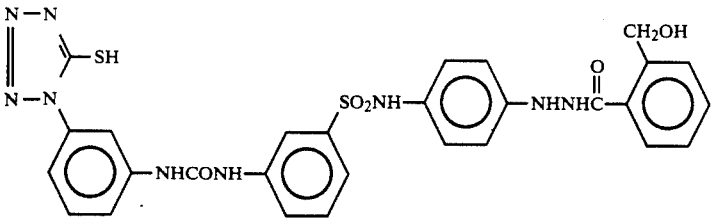
I-25
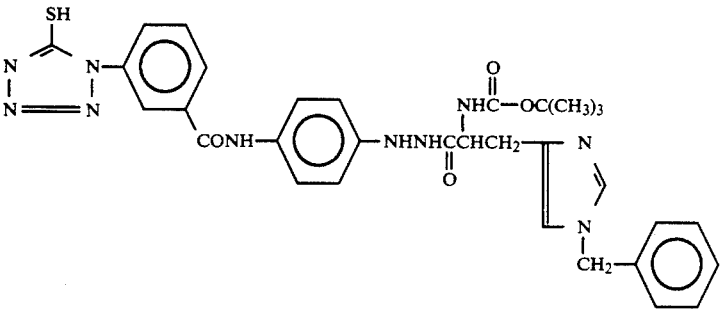

-continued

I-26

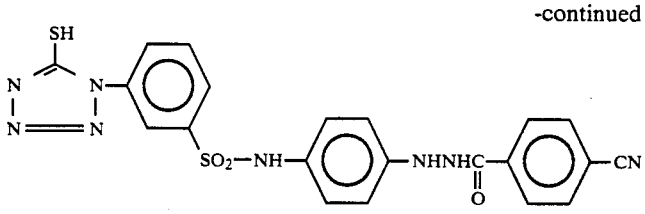

In addition to the hydrazine derivatives represented by formula (I), those disclosed in *Research Disclosure,* Item 23516 (November, 1983, p. 346) and the literature cited therein, as well as those disclosed in U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, JP-A-62-948, European Patent 217,310, and further, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-77057, and Japanese Patent Application Nos. 63-179760, 1-18377, 1-18378, 1-18379, 1-15755, 1-16814, 1-40792, 1-42615, 1-42616, 1-123693, and 1-126284 can be used.

The hydrazine derivative represented by formula (I) of the present invention is added to the photosensitive silver halide emulsion layer preferably in the range of from $1\times10^{-6}$ mol to $5\times10^{-2}$ mol per mol of silver halide in the same layer, and more preferably in the range of from $1\times10^{-5}$ to $2\times10^{-2}$ mol per mol of silver halide in the same layer.

The hydrazine derivatives other than those represented by the formula (I) can be added to the photosensitive silver halide emulsion layer in an amount of from 0.5 to 200 mg/m$^2$, preferably from 1 mg to 150 mg/m$^2$.

The hydrazine derivatives represented by the formula (I) can be prepared as described in JP-A-63-124045, JP-A-63-234244 and JP-A-63-286840.

To obtain a contrast of G 8 or more at pH 11.2 or less, it is advantageous to incorporate the compounds represented by formula (II) and/or formula (III) in the photographic material. These compounds are disclosed in JP-A-63-124045, JP-A-63-234244 and JP-A-63-286840.

The G value is a gradient determined from a sensitometric curve and is defined in T. H. James, *The Theory of the Photographic Process,* Macmillan Publishing Co., Inc., and A. Sasai, *Chemistry of Photography.*

The measurement of this G value is performed for a time of 30 seconds at 38° C., at a developer pH of 11.2 or less; any B/W developer may be used. G is given by the concentration difference for a difference of exposures (Δlog E) providing densities of 0.1 and 3.0.

$$Y\text{-}(X)_n A-B]_m \qquad \text{(II)}$$

In formula (II), Y represents a group which adsorbs onto silver halide. X represents a divalent linking group. A represents a divalent linking group. B represents an amino group, an ammonium group or a nitrogen-containing heterocyclic group, and the amino group may be substituted. m represents 1, 2 or 3, and n represents 0 or 1.

As the group Y which adsorbs onto silver halide, a nitrogen-containing heterocyclic group may be used.

When Y represents a nitrogen-containing heterocyclic group, the compound of formula (II) is represented by the following formula (II-a).

(II-a)

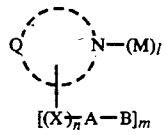

In the above formula, l represents 0 or 1, m represents 1, 2 or 3, and n represents 0 or 1. $[(X_n—A—B]_m$ has the same meaning as in formula (II); Q represents an atomic group necessary for forming a 5- or 6-membered heterocyclic ring constituted by at least one kind of atom of carbon, nitrogen, oxygen and sulfur atoms. Furthermore, this heterocyclic group may be condensed with a carboaromatic ring or a heterocyclic aromatic ring.

Useful examples of the heterocyclic group represented by Q include a substituted or unsubstituted indazole ring, benzimidazole ring, benzotriazole ring, benzoxazole ring, benzothiazole ring, imidazole ring, thiazole ring, oxazole ring, triazole ring, tetrazole ring, azaindene ring, pyrazole ring, indole ring, triazine ring, pyrimidine ring, pyridine ring, quinoline ring, etc.

M represents a hydrogen atom, an alkali metal atom (for example sodium, potassium, etc.), an ammonium group (for example, trimethylammonium, dimethylbenzylammonium, etc.), or a group capable of being a hydrogen atom or an alkali metal atom under an alkaline condition (for example, acetyl, cyanoethyl, and methanesulfonylethyl groups).

Furthermore, these heterocyclic groups may be substituted with a nitro group, a halogen atom (for example, chlorine, bromine), a mercapto group, a cyano group, a substituted or unsubstituted alkyl group (for example, methyl, ethyl, propyl, t-butyl, cyanoethyl, methoxyethyl, methylthioethyl), an aryl group (for example, phenyl, 4-methansulfonamidophenyl, 4-methylphenyl, 3,4-dichlorophenyl, naphthyl), an alkenyl group (for example, allyl), an aralkyl group (for example, benzyl, 4-methylbenzyl, phenethyl), an alkoxy group (for example, methoxy, ethoxy), an aryloxy group (for example, phenoxy, 4-methoxyphenoxy), an alkylthio group (for example, methylthio, ethylthio, methoxyethylthio), an arylthio group (for example, phenylthio), a sulfonyl group (for example, methanesulfonyl, ethanesulfonyl, p-toluenesulfonyl), a carbamoyl group (for example, an unsubstituted carbamoyl group, methylcarbamoyl, phenylcarbamoyl), a sulfamoyl group (for example, an unsubstituted sulfamoyl group, methylsulfamoyl, phenylsulfamoyl), a carboxamide group (for example, acetoamide, benzamide), a sulfonamide group (for example, methanesulfonamide, benzenesulfonamide, p-toluenesulfonamide), an acyloxy group (for example, acetyloxy, benzoyloxy), a sulfonyloxy group (for example, methanesulfonyloxy), a ureido group (for example, an unsubstituted ureido group, methylureido, ethylureido, phenylureido), a thioureido group (for example, an unsubstituted thioureido group, methylthioureido group), an acyl group (for example, acetyl, benzoyl), a heterocyclic group (for example, 1-morpholino, 1-piperidino, 2-pyridyl, 4-pyridyl, 2-thienyl, 1-pyrazolyl, 1-imidazolyl, 2-tetrahydrofuryl, tetrahydrothienyl), an oxycarbonyl group (for example, methoxycarbonyl, phenoxycarbonyl), an oxycarbonylamino group (for example, methoxycarbonylamino, phenoxycarbonamino, 2-ethylhexyloxycarbonylamino), an amino group (for example, an unsubstituted amino group, dimethylamino, methoxyethylamino, anilino), a carboxylic acid or its salts, a sulfonic acid or its salts, a hydroxy group, and the like.

Exemplary divalent linking groups represented by X include, for example,

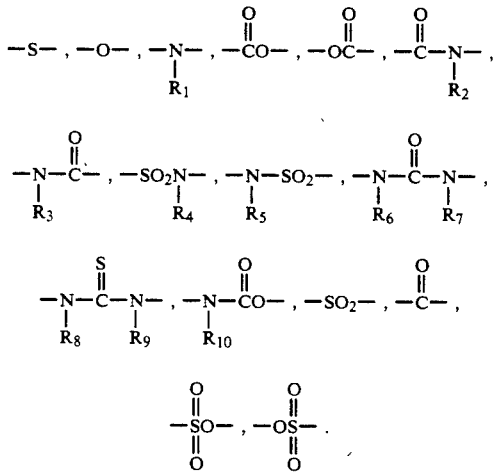

The divalent linking group may further include a straight chain or branched alkylene group (for example methylene, ethylene, propylene, butylene, hexylene, 1-methylethylene) between the above noted divalent group and Q. $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (for example, methyl, ethyl, propyl, n-butyl), a substituted or unsubstituted aryl group (for example, phenyl, 2-methylphenyl), a substituted or unsubstituted alkenyl group (for example, propenyl, 1-methylvinyl), or a substituted or unsubstituted aralkyl group (for example, benzyl; phenethyl).

A represents a divalent linking group including, for example, a straight chain or branched alkylene group (for example, methylene, ethylene, propylene, butylene, hexylene, 1-methylethylene), a straight chain or branched alkenylene group (for example, vinylene, 1-methylvinylene), a straight chain or branched aralkylene group (for example, benzylidene), an arylene group (for example, phenylene, naphthylene), etc. The above described groups represented by A can be further substituted with an optional combination of X and A.

The substituted or unsubstituted amino group represented by B is represented by formula (II-b).

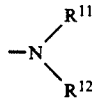

(II-b)

In the above formula, $R^{11}$ and $R^{12}$ may be the same or different, and each represents a hydrogen atom, a substituted or unsubstituted alkyl group, an alkenyl group or an aralkyl group each having 1 to 30 carbon atoms; these groups may be straight chain (for example, methyl, ethyl, n-propyl, n-butyl, n-octyl, allyl, 3-butenyl, benzyl, 1-naphthylmethyl), branched (for example, isopropyl, t-octyl), or cyclic (for example, cyclohexyl).

Furthermore, $R^{11}$ and $R^{12}$ may connect to form a ring, and may be cyclized to form a saturated heterocyclic ring containing one or more hetero atoms (for example, oxygen, sulfur, nitrogen); for example, a pyrrolidyl group, piperidyl group, or morpholino group. Furthermore, substituent groups of $R^{11}$ and $R^{12}$ include a carboxyl group, a sulfo group, a cyano group, a halogen atom (for example, fluorine, chlorine, bromine), a hydroxy group, an alkoxycarbonyl group having 20 carbon atoms or less (for example, methoxycarbonyl, ethoxycarbonyl, phenoxycarbonyl, benzyloxycarbonyl), an alkoxy group having 20 carbon atoms or less (for example, methoxy, ethoxy, benzyloxy, phenethyloxy), a monocyclic aryloxy group having 20 carbon atoms or less (for example, phenoxy, p-tolyloxy), an acyloxy group having 20 carbon atoms or less (for example, acetyloxy, propionyloxy), an acyl group having 20 carbon atoms or less (for example, acetyl, propionyl, benzoyl, mesyl), a carbamoyl group (for example, carbamoyl, N,N-dimethylcarbamoyl, morpholinocarbonyl, piperidinocarbonyl), a sulfamoyl group (for example, sulfamoyl, N,N-dimethylsulfamoyl, morpholinosulfonyl, piperidinosulfonyl), an acylamino group having 20 carbon atoms or less (for example, acetylamino, propionylamino, benzoylamino, mesylamino), a sulfonamide group (ethylsulfonamide, p-toluenesulfonamide), a carboxamide group having 20 carbon atoms or less (for example, methylcarboxamide, phenylcarboxamide), a ureido group having 20 carbon atoms or less (for example, methylureido, phenylureido), an amino group, etc.

The ammonium group represented by B is represented by formula (II-c).

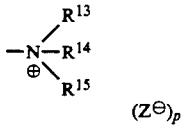

(II-c)

In the above formula, $R^{13}$, $R^{14}$, $R^{15}$ have the same definition as the groups $R^{11}$ and $R^{12}$ described above in formula (II-b); $Z^{\ominus}$ represents an anion, for example, a halide ion ($Cl^-$, $Br^-$, $I^-$), sulfonate ion (for example, trifluoromethanesulfonate, paratoluenesulfonate, benzenesulfonate, parachlorobenzenesulfonate), sulfate ion (for example, ethylsulfate, methylsulfate), perchlorate, tetrafluoroborate, etc. p represents an integer 0 or 1; in the case of a compound with salt formation in the molecule, p is 0.

The nitrogen-containing heterocyclic group represented by B is a 5- or 6-membered ring containing at least one nitrogen atom; these heterocyclic groups may be substituted, and furthermore may be condensed with other rings. Examples of the nitrogen-containing heterocyclic group include an imidazolyl group, a pyridyl group, a thiazolyl group, etc.

The compound represented by the following formulae (II-m), (II-n), (II-o), and (II-p) are preferred as the compound represented by formula (II).

(II-m)

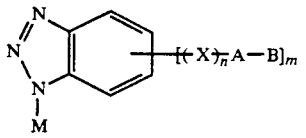

(II-n)

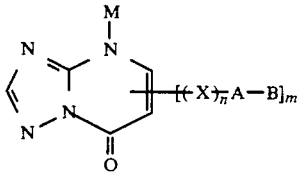

(II-o)

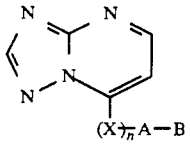

(II-p)

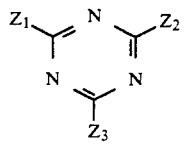

The compounds of formula (II) can be prepared by the process disclosed in JP-A-63-124045, JP-A-63-234244 and JP-A-63-286840.

In the above formulae, $(X)_n$—A—B, M, and m have the same meaning as in formula (II). $Z_1$, $Z_2$ and $Z_3$ have the same meaning as the group $(X)_n$—A—B in formula (II), or each represents a halogen atom, an alkoxy group having 20 carbon atoms or less (for example, methoxy), a hydroxy group, a hydroxyamino group, or a substituted or unsubstituted amino group, the substituents of which can be selected from the substituents of $R^{11}$ and $R^{12}$ in formula (II-b). However, at least one of $Z_1$, $Z_2$ and $Z_3$ is $(X)_n$—A—B group.

Furthermore, the above heterocyclic compounds may be substituted with the substituents suitable for the heterocyclic compounds of formula (II).

Exemplary compounds represented by formula (II) are shown below, but the present invention is not limited to these compounds.

II-1

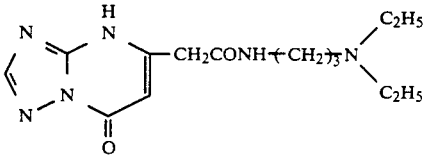

-continued

II-2

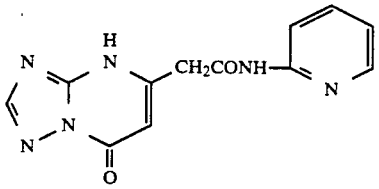

II-3

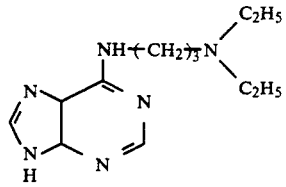

II-4

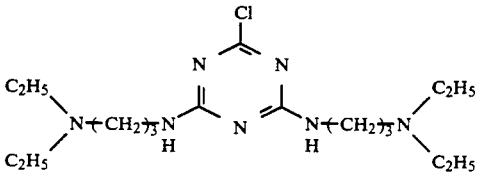

II-5

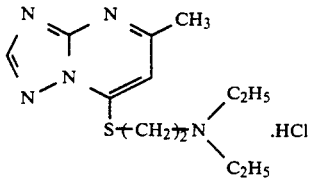

II-6

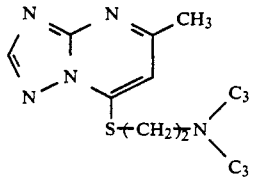

II-7

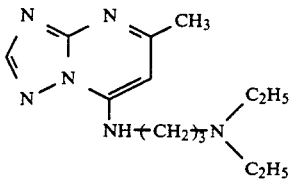

II-8

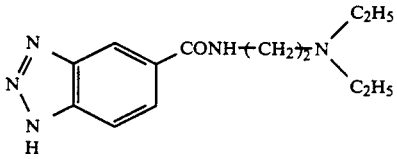

II-9

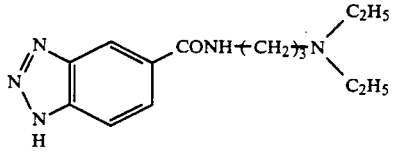

II-10

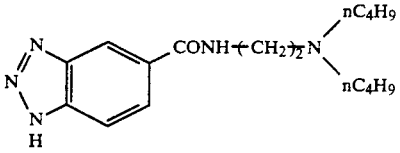

-continued

II-11

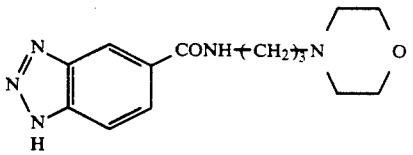

II-12

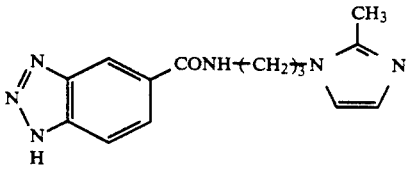

II-13

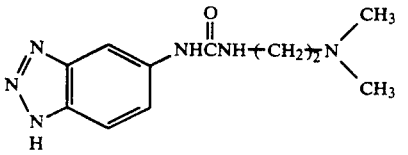

II-14

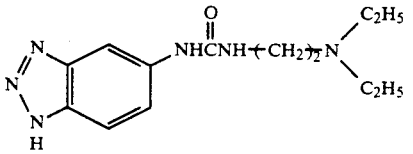

II-15

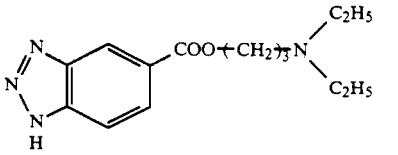

II-16

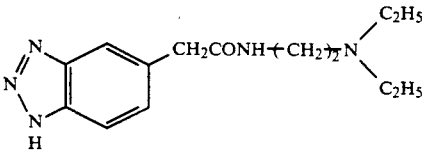

II-17

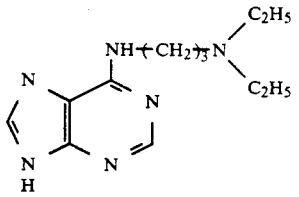

II-18

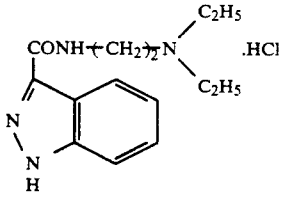

II-19

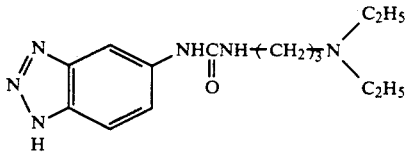

-continued

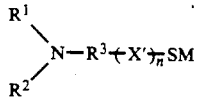

(III)

In the above formula, $R^1$ and $R^2$ each represents a hydrogen atom or an aliphatic residue.

$R^1$ and $R^2$ may bond together to form a ring.

$R^3$ represents a divalent aliphatic group.

X' represents a divalent 5- or 6-membered heterocyclic group containing a nitrogen atom, an oxygen atom or a sulfur atom.

n represents 0 or 1.

M represents a hydrogen atom, an alkali metal, an alkaline earth metal, a quaternary ammonium group, a quaternary phosphonium group, or an amidino group.

The aliphatic residue represented by $R^1$ and $R^2$ is preferably an alkyl group, an alkenyl group or an alkynyl group having 1 to 12 carbon atoms, which aliphatic group may be substituted. The alkyl group is, for example, methyl, ethyl, propyl, butyl, hexyl, decyl, dodecyl, isopropyl, sec-butyl, cyclohexyl. The alkenyl group is, for example, allyl, 2-butenyl, 2-hexenyl, 2-octenyl. The alkynyl group is, for example, propargyl, 2-pentynyl. Useful substituent groups include a phenyl group, a substituted phenyl group, an alkoxy group, an alkylthio group, a hydroxy group, a carboxyl group, a sulfo group, an alkylamino group, and an amide group.

When a ring is formed by $R^1$ and $R^2$, it is a 5- or 6-membered carbocyclic or heterocyclic ring formed from the combination of carbon atoms or nitrogen and/or oxygen atoms; in particular, it is preferably a saturated ring including, for example, the groups noted below.

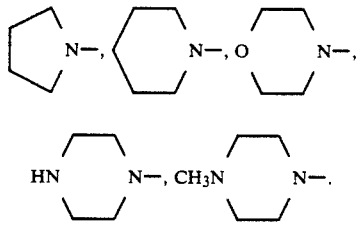

Particularly preferred as $R^1$ and $R^2$ are an alkyl group having 1 to 3 carbon atoms, more preferably an ethyl group.

Preferred examples of the divalent aliphatic group for $R^3$ include $—R^4—$ or $—R^4S—$ wherein $R^4$ represents a saturated or unsaturated divalent aliphatic residue preferably having 1 to 6 carton atoms, for example, $—CH_2—$, $—CH_2CH_2—$, $—(CH_2)_3—$, $—(CH_2)_4—$, $—(CH_2)_6—$, $—CH_2CH{=}CHCH_2—$, $—CH_2C{\equiv}CCH_2—$, $$—CH_2\underset{\underset{CH_3}{|}}{C}HCH_2—.$$

The preferred number of carbon atoms for $R_{hu\,4}$ is 2 to 4; $—CH_2CH_2—$ or $—CH_2CH_2CH_2—$ are more preferred for $R^4$.

The divalent heterocyclic group X' is a 5- or 6-membered heterocyclic group containing nitrogen, oxygen or sulfur, and may be fused with a benzene ring. The heterocyclic group is preferably aromatic, for example, tetrazole, triazole, thiadiazole, oxadiazole, imidazole, thiazole, oxazole, benzimidazole, benzothiazole, benzoxazole. Tetrazole and thiazole are particularly preferred among these.

The alkali metal represented by M includes $Na^+$, $K^+$ and $Li^+$.

The alkaline earth metal represented by M includes $Ca^{++}$ and $Mg^{++}$.

The quaternary ammonium salt represented by M has 4 to 30 carbon atoms including, for example, $(CH_3)_4N^{\oplus}$, $(C_2H_5)_4N^{\oplus}$, $(C_4H_9)_4N^{\oplus}$, $C_6H_5CH_2N^{\oplus}(CH_3)_3$ and $C_{16}H_{33}N^{\oplus}(CH_3)_3$. The quaternary phosphonium salt represented by M includes $(C_4H_9)_4P^{\oplus}$, $C_{16}H_{33}P^{\oplus}(CH_3)_3$ and $C_6H_5CH_2P^{\oplus}(CH_3)_3$.

The inorganic acid salts of the compounds represented by formula (III) include chlorides, sulfates, phosphates, etc.; the salts of organic acids include propionates, methanesulfonates, benzenesulfonates, p-toluenesulfonates, etc.

The compounds represented by formula (III) can be prepared by the process disclosed in JP-A-63-124045, JP-A-63-234244 and JP-A-63-286840.

Specific examples of the compounds represented by formula (III) are described below, but the present invention is not limited thereto.

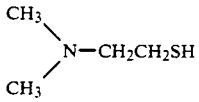
III-1

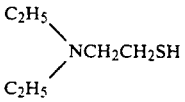
III-2

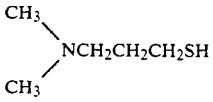
III-3

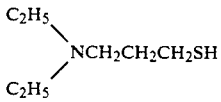
III-4

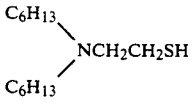
III-5

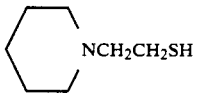
III-6

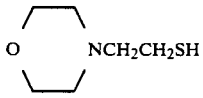
III-7

$(HOCH_2CH_2)_2NCH_2CH_2SH$ III-8

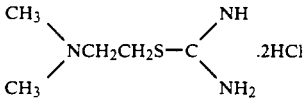
III-9

-continued

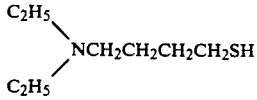
III-10

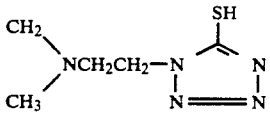
III-11

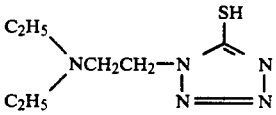
III-12

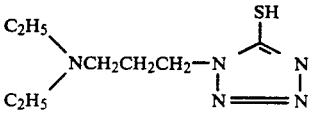
III-13

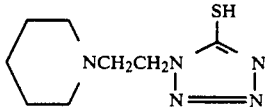
III-14

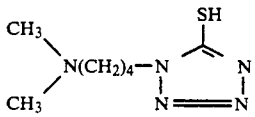
III-15

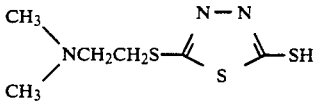
III-16

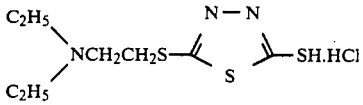
III-17

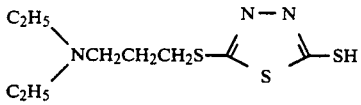
III-18

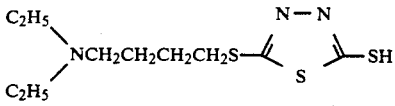
III-19

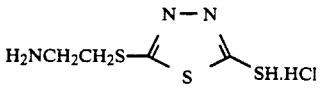
III-20

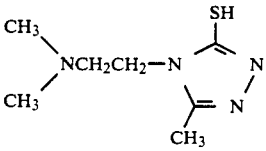
III-21

-continued

III-22

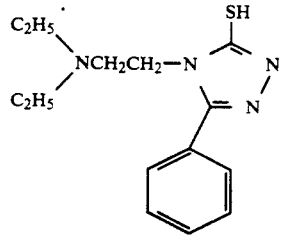

The accelerators represented by formulae (II) and (III) can be added to emulsion layers and/or layers adjacent to the emulsion layers.

The addition amount of the accelerator represented by formulae (II) and (III) varies depending on the particular compound selected, but is generally used in an amount of $1.0\times10^{-3}$ to 0.5 g/m$^2$, preferably $5.0\times10^{-3}$ to 0.3 g/m$^2$ of the photographic material. These accelerators are dissolved in a suitable solvent ($H_2O$, alcohols such as methanol or ethanol, acetone, dimethylformamide, methyl cellosolve and the like) and added to the coating solution.

The above described additives represented by formulae (II) and (III) may be used in combination.

The redox compounds of the present invention which upon oxidation release a development inhibitor are described below.

The redox compounds for use in the present invention preferably include hydroquinones, catechols, naphthohydroquinones, aminophenols, pyrazolidones, hydrazines, hydroxylamines, reductones, etc.; more preferably, the redox compounds are hydrazines.

The hydrazines for use in the present invention which upon oxidation release a development inhibitor are preferably represented by formula (R-1), formula (R-2), or formula (R-3). The compounds represented by formula (R-1) are particularly preferred.

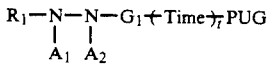

(R-1)

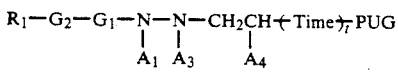

(R-2)

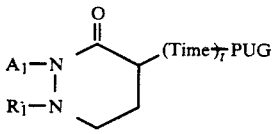

(R-3)

In the above formulae, $R_1$ represents an aliphatic group or an aromatic group. $G_1$ represents

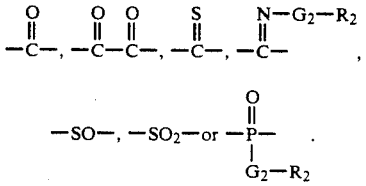

$G_2$ represents a single bond, —O—, —S— or

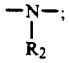

$R_2$ represents a hydrogen atom or $R_1$.

$A_1$ and $A_2$ each represents a hydrogen atom, an alkylsulfonyl group, an arylsulfonyl group or an acyl group, and may be substituted. In formula (R-1), at least one of $A_1$ and $A_2$ is a hydrogen atom. $A_3$ has the same meaning as $A_1$ or represents

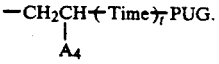

$A_4$ represents a nitro group, a cyano group, a carboxyl group, a sulfo group or $—G_1—G_2—R_1$.

Time represents a divalent linking group; t represents 0 or 1. PUG represents a development inhibitor.

Formulae (R-1), (R-2) and (R-3) are described in detail below.

In formulae (R-1), (R-2) and (R-3), the aliphatic group represented by $R_1$ preferably has 1 to 30 carbon atoms, and particularly is a straight chain, branched or cyclic alkyl group having 1 to 20 carbon atoms. This alkyl group may be substituted.

In formulae (R-1), (R-2) and (R-3), the aromatic group represented by $R_1$ is preferably a monocyclic or bicyclic aryl group or an unsaturated heterocyclic group. Here, the unsaturated heterocyclic group may form a heteroaryl group by condensation with an aryl group, for example, a benzene ring, a naphthalene ring, a pyridine ring, a quinoline ring, or an isoquinoline ring, and those containing a benzene ring are preferred.

An aryl group is particularly preferred as $R_1$.

The aryl group or unsaturated heterocyclic group represented by $R_1$ may be substituted. Representative substituent groups include, for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an aryloxycarbonyl group, an acyl group, an alkoxycarbonyl group, an acyloxy group, a carboxamido group, a sulfonamide group, a carboxyl group, or a phosphoramide group, etc.; preferred substituents are straight chain, branched or cyclic alkyl groups (preferably having 1 to 20 carbon atoms), aralkyl groups (preferably having 7 to 30 carbon atoms), alkoxy groups (preferably having 1 to 30 carbon atoms), substituted amino groups (preferably alkyl-substituted amino groups having 1 to 30 carbon atoms), acylamino groups (preferably having 2 to 40 carbon atoms), sulfonamide groups (preferably having 1 to 40 carbon atoms), ureido groups (preferably having 1 to 40 carbon atoms), phosphoramide groups (preferably having 1 to 40 carbon atoms), etc.

As $G_1$ in formulae (R-1), (R-2) and (R-3), a

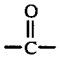

group or an $—SO_2$ group is preferred; a $$-\overset{\overset{\displaystyle O}{\|}}{C}-$$

group is most preferred.

A hydrogen atom is preferred as $A_1$ and $A_2$; a hydrogen atom or $$-\underset{\underset{\displaystyle A_4}{|}}{CH_2CH}(Time)_t PUG$$

is preferred as $A_3$.

In formulae (R-1), (R-2) and (R-3), Time represents a divalent linking group, and may possess a timing control function.

The divalent linking group represented by Time represents a group which brings about the release of PUG via one or more reaction steps from Time-PUG. -Time-PUG- is released from the oxidation product of the oxidation reduction parent nucleus.

The divalent linking group represented by Time includes, for example, p-nitrophenoxy derivatives which release PUG by an intramolecular ring closure reaction as disclosed in U.S. Pat. No. 4,248,962 (JP-A-54-145135), etc.; those disclosed in U.S. Pat. No. 4,310,612 (JP-A-55-53330) and U.S. Pat. No. 4,358,525, etc., which release PUG by an intramolecular ring closing reaction after ring cleavage; succinic acid monoesters or their analogs, in which the release of PUG accompanies the formation of acid anhydride by intramolecular ring closure reaction of the carboxyl group as disclosed in U.S. Pat. Nos. 4,330,617, 4,446,216 and 4,483,919 and in JP-A-59-121328, etc,; aryloxy groups or heterocyclic oxy groups as disclosed in U.S. Pat. Nos. 4,409,323 and 4,421,845, *Research Disclosure,* No. 21228 (December, 1981), U.S. Pat. No. 4,416,977 (JP-A-57-135944), JP-A-58-209736 and JP-A-58-209738, etc., which release PUG with the formation of quinomonomethane or its analogs by electron transfer via conjugated bonds; U.S. Pat. No. 4,420,554 (JP-A-57-136640), JP-A-57-135945, JP-A-57-188035, JP-A-58-98728 and JP-A-58-209737, etc., which release PUG from the $\gamma$-position of an enamine by electron transfer of a portion possessing an enamine structure of a nitrogen-containing heterocyclic; those disclosed in JP-A-57-56837, which release PUG by an intramolecular ring closure reaction of an oxy group formed by electron transfer from a carbonyl group conjugated with a nitrogen atom of a nitrogen-containing heterocyclic; those disclosed in U.S. Pat. No. 4,146,396 (JP-A-52-90932), JP-A-59-93442, JP-A-59-75475, JP-A-60-249148, JP-A-60-249149, etc., which release PUG accompanying the formation of aldehyde; those disclosed in JP-A-51-146828, JP-A-57-179842 and JP-A-59-104641, which release PUG accompanying the decarboxylation of a carboxyl group; those possessing a —O—$COOCR_aR_b$—PUG structure ($R_a$ and $R_b$ represent monovalent groups), which release PUG accompanying decarboxylation and the successive formation of aldehyde; those disclosed in JP-A-60-7429, which release PUG accompanying the formation of isocyanate; and those disclosed in U.S. Pat. No. 4,438,193, etc., which release PUG by a coupling reaction with the oxidation product of a color developing agent.

Specific examples of the divalent linking group represented by Time are disclosed in detail in JP-A-61-236549 and JP-A-1-269936.

PUG represents a group which possesses development inhibiting effects as $(Time)_t$PUG or PUG.

The development inhibitors represented by PUG or $(Time)_t$PUG possess a hetero atom, and are the well known development inhibitors bonded via a hetero atom, as disclosed, for example, in C. E. K. Mees and T. H. James, *The Theory of the Photographic Processes,* 3rd Edition, Macmillan Publishing Co., Inc., 1966, pages 344 to 346.

The development inhibitor represented by PUG may be substituted. Useful substituent groups include those enumerated as substituents of $R_1$. The substituent groups may be further substituted.

The substituent group is preferably a nitro group, a sulfo group, a carboxyl group, a sulfamoyl group, a phosphonic group, a phosphinico group, or a sulfonamide group.

Furthermore, formulae (R-1), (R-2) and (R-3) may include in $R_1$ or $(Time)_t$PUG a ballast group commonly used in passive photographic additives of couplers, etc., or the compounds represented by formulae (R-1), (R-2) and (R-3) may include groups which promote adsorption onto silver halide.

The ballast groups are organic groups which provide a molecular weight such that the compounds represented by formulae (R-1), (R-2) and (R-3) substantially do not diffuse into other layers or into the processing solutions, and include one or more of alkyl groups, aryl groups, heterocyclic groups, ether groups, thioether groups, amide groups, ureido groups, urethane groups, sulfonamide groups, etc. The ballast group preferably contains a substituted benzene ring, and a ballast group having a benzene ring substituted with a branched alkyl group is particularly preferred.

Groups which promote adsorption onto silver halide include cyclic thioamide groups such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, and 1,3-imidazoline-2-thione; chain thioamide groups, aliphatic mercapto groups, aromatic mercapto groups, heterocyclic mercapto groups (the case where a nitrogen atom is adjacent to the carbon atom bonded to the —SH group is tautomeric with the cyclic thioamide group; specific examples of this group are the same as recited above), groups possessing disulfide bonds, 5- or 6-membered heterocyclic nitrogen-containing groups consisting of combinations of nitrogen, oxygen, sulfur and carbon, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, azaindene, and heterocyclic quaternary salts such as benzimidazolium.

These groups may be further substituted with an appropriate substituent, and useful substituent groups may be selected from the substituent groups for $R_1$.

Specific examples of the redox compound which releases a development inhibitor upon oxidation for use in the present invention are listed below, but the present invention is not limited to these compounds.

IV-1
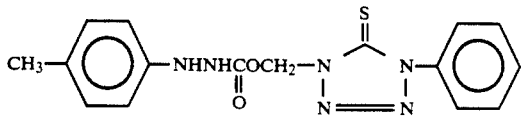
IV-2
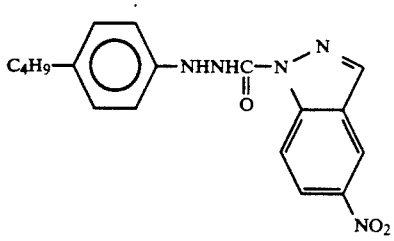
IV-3
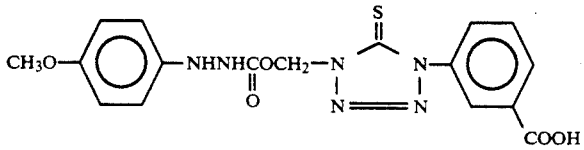
IV-4
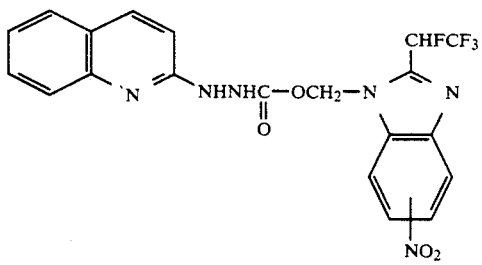
IV-5
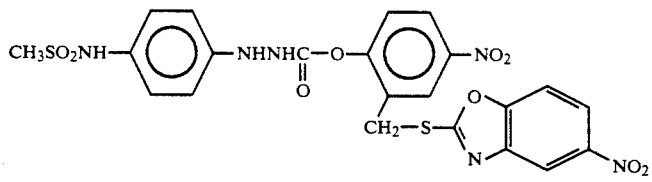
IV-6
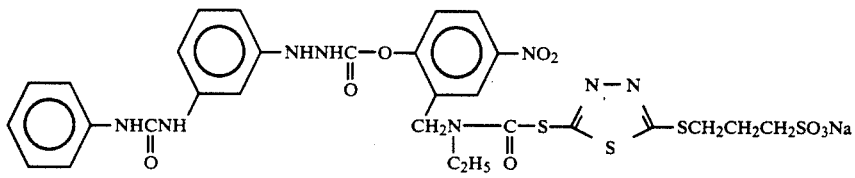
IV-7
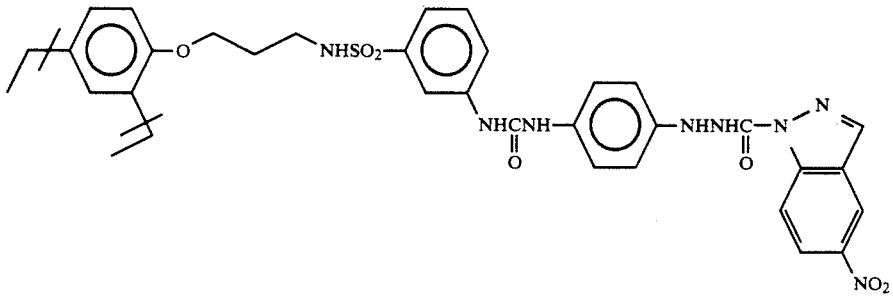

-continued
IV-8
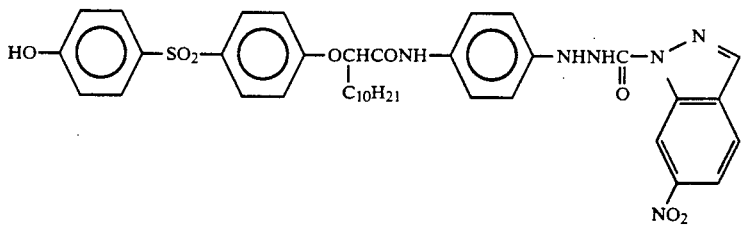
IV-9
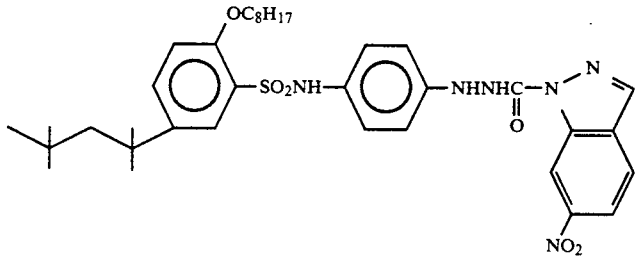
IV-10
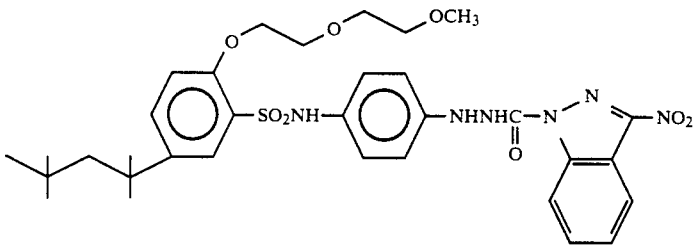
IV-11
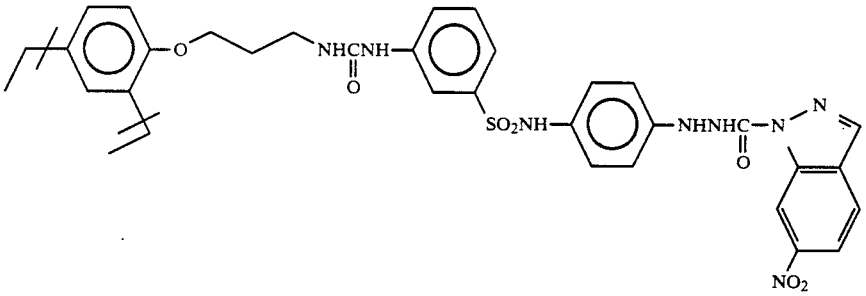
IV-12
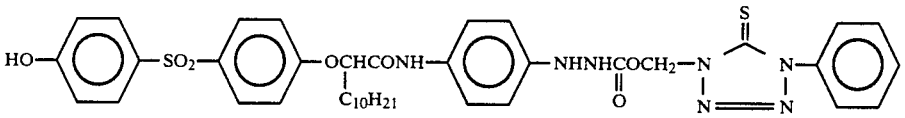
IV-13
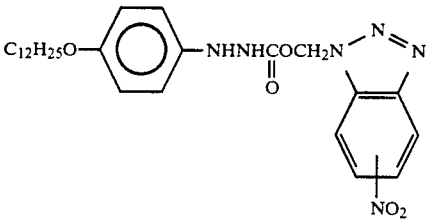

-continued
IV-14
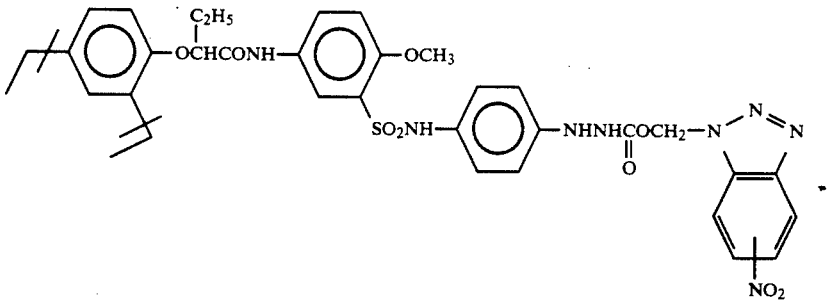
IV-15
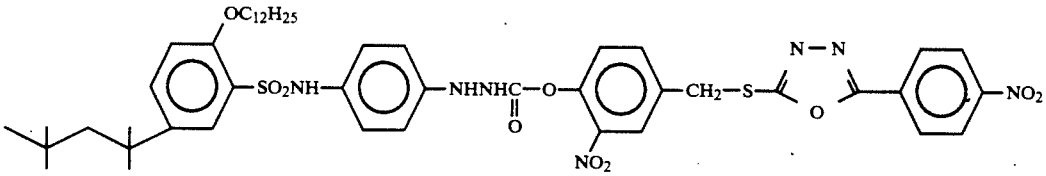
IV-16
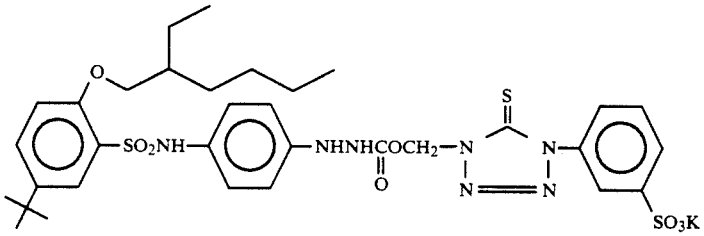
IV-17
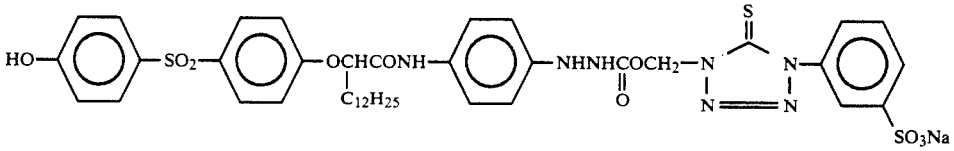
IV-18
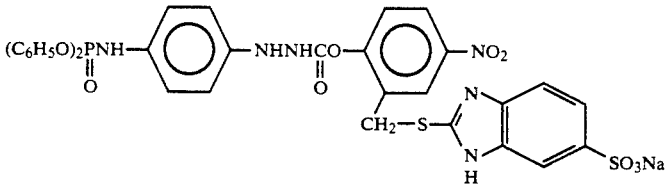
IV-19
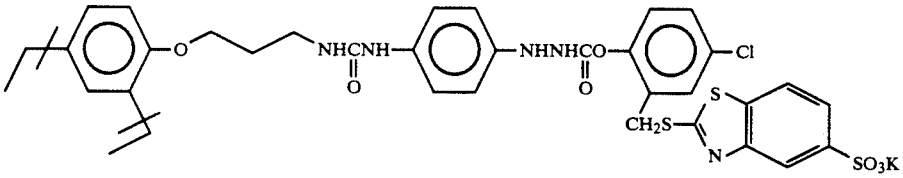
IV-20
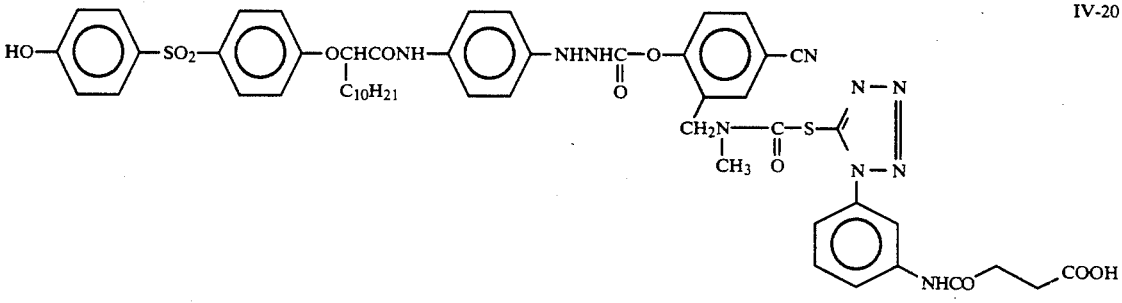

-continued
IV-21
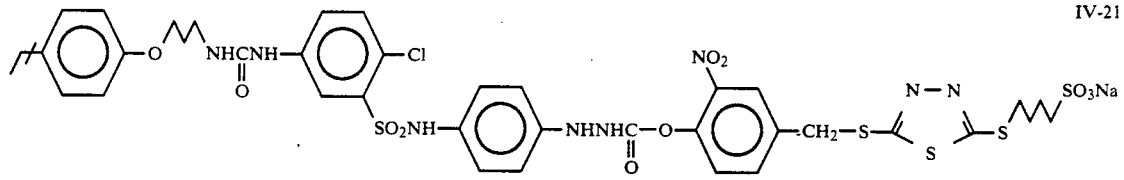
IV-22
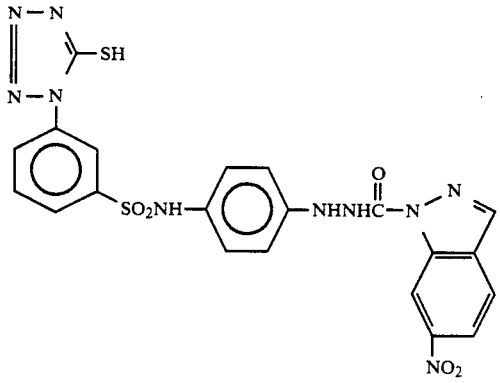
IV-23
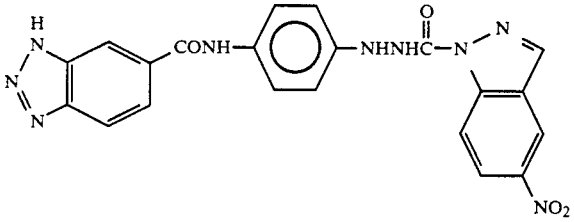
IV-24
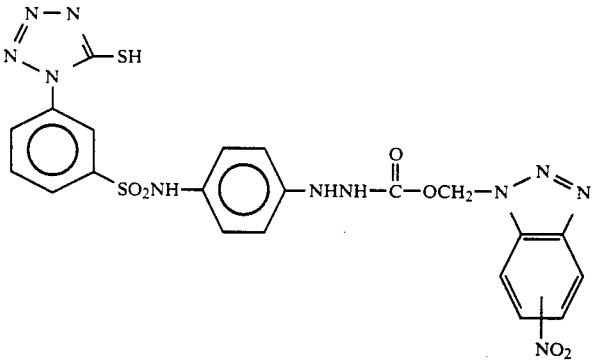
IV-25
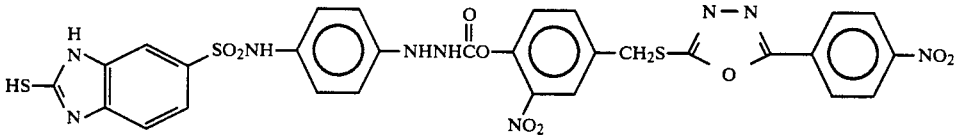
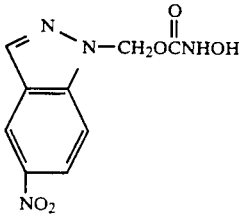

-continued
IV-26
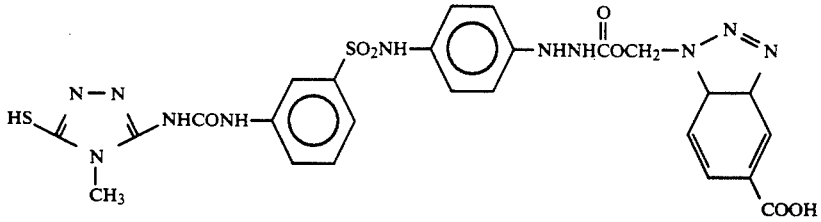
IV-27
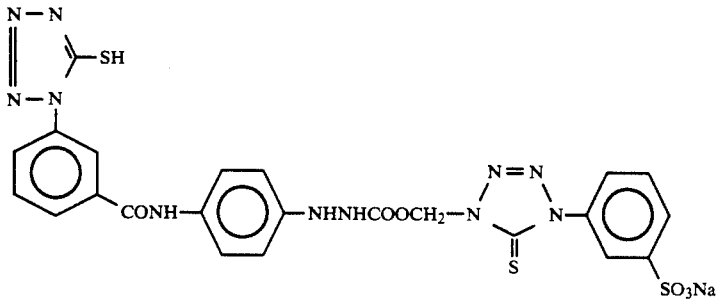
IV-28
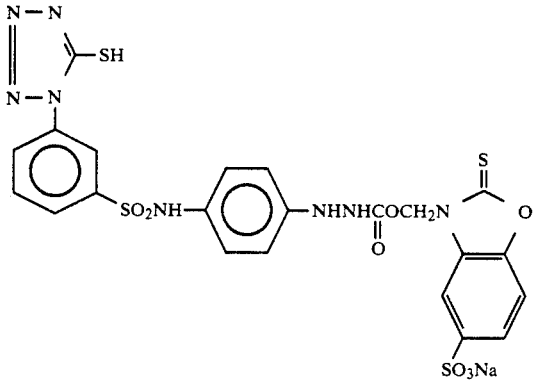
IV-29
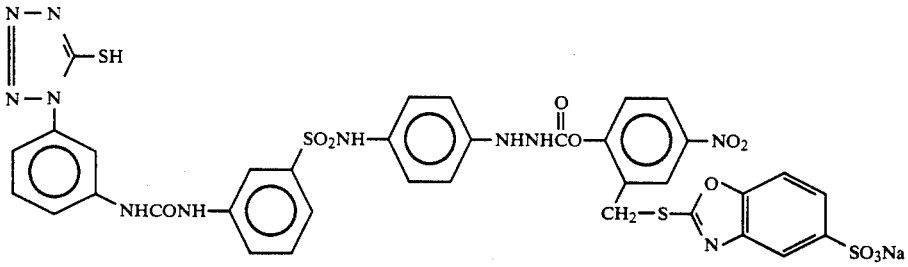
IV-30
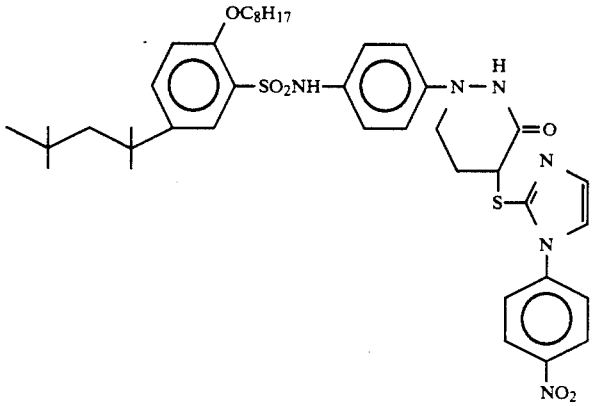

-continued
IV-31
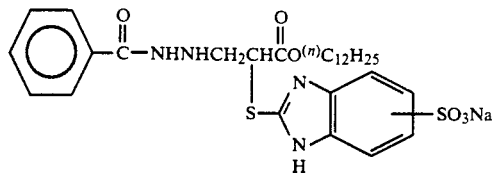
IV-32
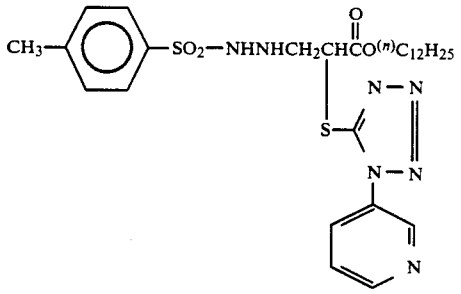
IV-33
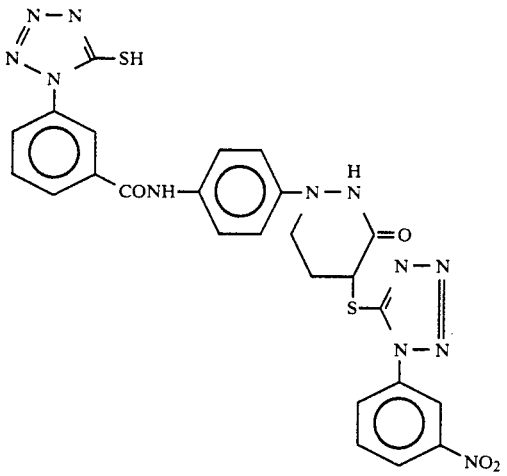
IV-34
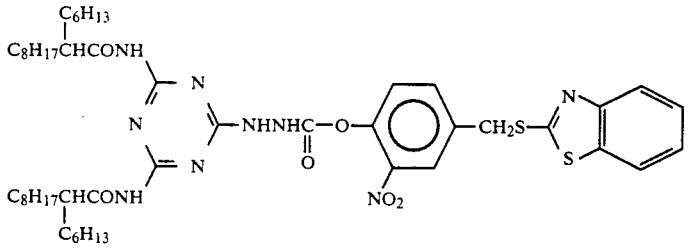
IV-35
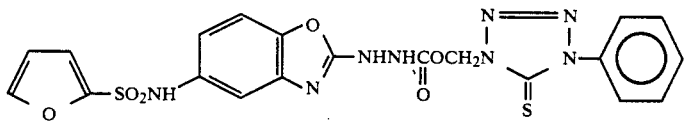
IV-36
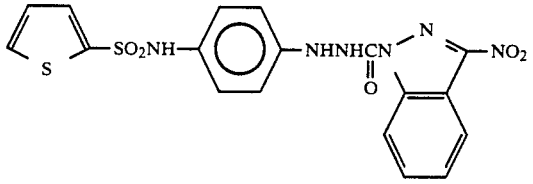
The redox compounds disclosed in JP-A-61-213847 and JP-A-2-260153, and in Japanese Patent Application Nos. 1-102393, 1-102394, 1-102395, and 1-114455 may be used in the present invention.

The redox compounds for use in the present invention may be synthesized according to the methods disclosed, for example, in JP-A-61-213847 and JP-A-62-260153, U.S. Pat. No. 4,684,604, JP-A-1-269936, U.S. Pat. Nos. 3,379,529, 3,620,746, 4,377,634 and 4,332,878, JP-A-49-129536, JP-A-56-153336 and JP-A-56-153342, etc.

The redox compound of the present invention is used in an amount of from $1\times10^{-6}$ to $5\times10^{-2}$ mol, more preferably from $1\times10^{-5}$ to $1\times10^{-2}$ mol, per mol of silver halide.

The redox compound of the present invention is added to a hydrophilic colloid layer other than the layer to which the hydrazine derivative represented by formula (R-1) is added, and it is particularly preferred to incorporate the redox compound in the layer above the photosensitive layer containing the hydrazine derivative represented by formula (I).

The hydrophilic colloid layer comprises a binder such as carboxymethyl cellulose, dextran, starch, polyvinyl alcohol, poly-N-vinylpyrrolidone, polyacrylic acid, polyacrylamide, gelatin, e.g., acid-treated gelatin and alkali-treated gelatin, preferably gelatin. The thickness of the hydrophilic colloid layer can be in the range of from 0.01 to 3 μm, preferably from 0.05 to 2 μm.

The layer containing the redox compound of the present invention may further contain photosensitive or non-photosensitive silver halide emulsion grains. Also, an auxiliary photosensitive emulsion layer containing no hydrazine derivative can be provided adjacent to the layer containing the redox compound of the present invention. An intermediate layer containing gelatin or a synthetic polymer (polyvinyl acetate, polyvinyl alcohol, etc.) may be provided between the layer which contains the redox compound of the present invention and the photosensitive layer which contains the hydrazine compound.

The silver halide for use in the present invention is prepared, for example, by the method disclosed in the literature, T. H. James et al., *The Theory of the Photographic Process*, 4th. Ed., Macmillan Publishing Co., Inc. (1977), pages 88 to 104; by the acid method, ammonia method, sequential mixing method, reverse mixing method, double jet method, controlled double jet method, core-shell method, etc.

The grain size, grain form, distribution and the like can be controlled by using, according to requirements, silver halide solvents such as thioethers, thioureas, etc.

There are no particular limitations on the grain size, grain size distribution, crystal habit, form (regular crystals, twinned crystals, etc.), but preferably the grain size is uniform, having a size of from 0.05 to 8 μm.

Furthermore, the grain size distribution is preferably monodisperse, a monodisperse distribution being one with 95% of the grains within ±60% of the average grain size, and preferably is a dispersion system included within ±40% of this size.

As described above, there are no particular limitations on the crystal habit and shape of the silver halide grains, but cubic or octahedral grains, 14-faced or mixtures of these grains are preferred, and octahedral or 14-faced grains are particularly preferred.

Silver bromide, silver iodobromide, silver chlorobromide, and silver chloroiodobromide are preferred as the silver halide; it is necessary for the bromine content to be 70 mol % or more. Preferably the Br content is 80 mol % or more, and a Br content of 90 mol % or more is particularly preferred. The silver iodide content is usually less than 10 mol %, and is preferably less than 5 mol %.

Cadmium salts, sulfites, lead salts, thallium salts, rhodium salts or their complexes, or iridium salts or their complexes, etc., may be copresent in the process of formation or physical ripening of the silver halide grains of the silver halide emulsion for use in the present invention.

It is particularly preferred to add $10^{-8}$ to $10^{-5}$ mol of iridium salt per mol of Ag, and furthermore, $10^{-8}$ to $10^{-4}$ mol of rhodium salt per mol of Ag.

Chemical sensitization of the silver halide may be carried out after the grain formation and desalting processes, or the silver halide grains may be used without chemical sensitization.

Useful chemical sensitizing agents include sulfur sensitizers, for example, sodium thiosulfate, thiourea; noble metal sensitizers, for example, gold sensitizers, specifically, chloroauric acid salts, gold trichloride, etc., palladium sensitizers, specifically palladium chloride, chloropalladic acid salts, etc., platinum compounds, iridium compounds, etc.; selenium sensitizers, for example, selenous acid, selenourea, etc.; reducing sensitizers, for example, stannous chloride, polyamines such as diethylenetriamine, sulfite salts, silver nitrate, can be used as chemical sensitizers, alone or in combination, to carry out chemical sensitization.

The sensitizing dyes for use in the present invention can be well known sensitizing dyes used in the field of photographic materials, for example, including cyanine dyes, merocyanine dyes, complex cyanine dyes, complex merocyanine dyes, holopolar cyanine dyes, hemicyanine dyes, styryl dyes and hemioxonol dyes. Particularly useful dyes are dyes belonging to the cyanine dyes, merocyanine dyes, and complex merocyanine dyes. In these dyes, any of the basic heterocyclic nuclei generally used in cyanine dyes can be applied. Namely, a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; nuclei with alicyclic hydrocarbon nuclei fused to these nuclei; and nuclei with aromatic hydrocarbon nuclei fused to these nuclei, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can form the dye nucleus. These nuclei may be substituted on the carbon atoms.

For merocyanine dyes and complex merocyanine dyes, nuclei possessing a ketomethylene structure, a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, and the like 5- or 6-membered heterocyclic nucleus can form the dye nucleus. Useful sensitizing dyes are disclosed, for example, in U.S. Pat. Nos. 2,230,658, 2,493,748, 2,503,776, 2,519,001, 2,912,329, 3,656,959, 3,672,897, and 3,694,217, British Patent 1,242,588, JP-B-44-14040 (the term "JP-B" as used herein refers to an "examined Japanese patent publication"), JP-A-53-137133, JP-A-55-45015 and JP-A-62-235947.

These sensitizing dyes may be used alone or in combination, and combinations of sensitizing dyes are frequently used, particularly for the purpose of strong color sensitization. Together with the sensitizing dyes, materials may be contained in the silver halide emulsion which provide strong dye sensitization, which materials themselves have no spectral sensitizing action or which substantially do not absorb visible light.

Useful sensitizing dyes, combinations of dyes which provide strong sensitization, and materials which provide strong color sensitization are disclosed in *Research Disclosure*, 176, Vol. 17643 (December, 1978), No. 23, p. IV, paragraphs A to J.

In the present invention, the sensitizing dyes, etc., can be added and used in any procese of the preparation of the photographic emulsion, and can be added at any stage after preparation of the emulsion until just prior to coating. The preparation of the emulsion includes the formnation of the grains, etc., during physical ripening, and during chemical ripening.

The sensitizing dyes used in the present invention are added to the silver halide emulsion as an aqueous solution or the dyes are added as a solution in an organic solvent which is miscible with water, for example, methanol, ethanol, propyl alcohol, methyl cellosolve, pyridine, etc.

The period during which the sensitizing dyes used in the present invention are added to the emulsion is before the emulsion is coated onto a suitable support, but may generally, however, be added to the emulsion during the chemical ripening process or during the process of formation of the silver halide emulsion.

The sensitizing dye for use in the present invention is preferably added in an amount of from $10^{-6}$ to $10^{-1}$ mol per mol of silver, preferably $10^{-4}$ to $10^{-2}$ mol per mol of silver.

The above described sensitizing dyes may be used alone or in combination; a combination of photosensitizing dyes is frequently used to provide strong color sensitization.

The dyes preferably used in the present invention have an absorption peak at a wavelength of 300 to 420 nm (containing ultraviolet absorbing agents). Specific examples are those disclosed in JP-A-62-210458, JP-A-63-104046, JP-A-63-103235, JP-A-63-208846, JP-A-1-61745, JP-A-63-306436 and JP-A-63-314535, etc. These dyes do not reduce sensitivity, and the exposure latitude image quality (simultaneous reproducibility of Ming and Gothic characters) is improved.

The substance having an absorption peak at 300 to 420 nm preferably used in the present invention includes, for example, aryl-substituted benzotriazole compounds, 4-thiazolidone compounds, benzophenone compounds, cinnamic acid ester compounds, butadiene compounds, benzoxazole compounds and ultraviolet absorbing polymers.

It is desirable to use these dyes in conjunction with, in particular, ortho-sensitized silver chlorobromide having a bromide content of 70 mol % or more, silver iodochlorobromide, silver iodobromide, or silver bromide.

The above described dye compounds are preferably added to the silver halide photographic material in the layers provided on the support on the side having light-sensitive silver halide emulsion layers, e.g., to a silver halide emulsion layer or a protective coating layer in an amount of from 5 to 400 mg/m$^2$, preferably 10 to 300 mg/m$^2$ of the photographic material.

Furthermore, compounds particularly preferred for use as the dye having an absorption maximum of 300 to 420 nm are represented by formulae (D-1), (D-2), (D-3) or (D-4):

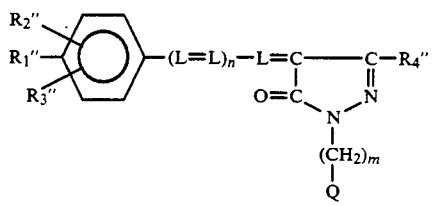

(D-1)

In the above formula, $R_1''$ is an atomic grouping representing —OX or

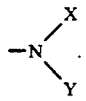

X and Y each represents a hydrogen atom, alkyl group, a cyanoalkyl group, a carboxyalkyl group, a sulfoalkyl group, a hydroxyalkyl group, a halogenated alkyl group or an alkyl group which may be substituted or its sodium or potassium salt; $R_2''$ and $R_3''$ each represents a hydrogen atom, a halogen atom, an alkyl group, a hydroxy group, an alkoxy group, an alkylthio group, or an —OX group; Q represents a phenyl group or a sulfoalkyl group each substituted with at least one of a halogen atom, a carboxy group, a sulfo group or a sulfoalkyl group or its sodium or potassium salt; a sulfoalkoxyalkyl group, or a sulfoalkylthioalkyl group; and L represents a methyl group which may be substituted. $R_4''$ represents an alkyl group, a carboxy group, an alkyloxycarbonyl group or an acyl substituted or unsubstituted amino group. m denotes an integer of 1 or 2, n denotes an integer of 0 or 1, respectively.

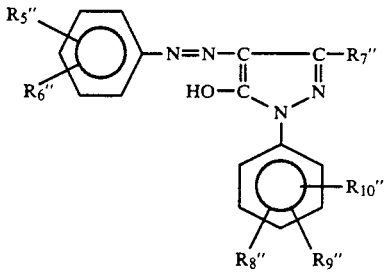

(D-2)

In the above formula, $R_5''$, $R_6''$, $R_8''$, $R_9''$ and $R_{10}''$ each represents a hydrogen atom, a halogen atom, an alkyl group, a hydroxyl group, an alkoxy group, an amino group, an acylamino group, a carboxyl group or a sulfone group or its sodium or potassium salt, $R_7''$ represents an alkyl group or a carboxyl group.

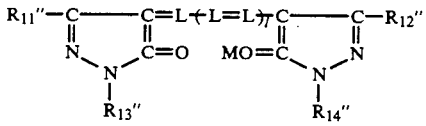

(D-3)

In the above formula, $R_{11}''$ and $R_{12}''$ each represents an alkyl group, a substituted alkyl group, an aryl group, an alkoxycarbonyl group or a carboxyl group; $R_{13}''$ and $R_{14}''$ each represents an alkyl group substituted with a sulfonic acid group or a carboxyl group, or an aryl group substituted with a sulfonic acid group or a carboxyl group, or a sulfonic acid group, or their sodium or potassium salts; L represents a substituted or unsubstituted methine chain. M represents sodium, potassium, or a hydrogen atom; l denotes 0 or 1.

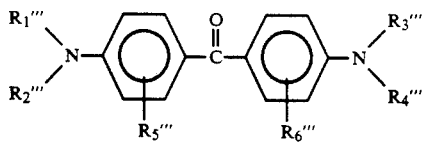

(D-4)

In the above formula, $R_1'''$, $R_2'''$, $R_3'''$ and $R_4'''$ each represents a hydrogen atom, a hydroxyalkyl group, a cyano group, an alkylcyano group, an alkoxy group or a sulfoalkyl group. $R_5'''$ and $R_6'''$ each represents a sulfonic acid group or an alkylsulfonic acid group.

Specific examples of preferred dyes for use in the present invention are shown below, but the present invention is not limited thereto.

D-1

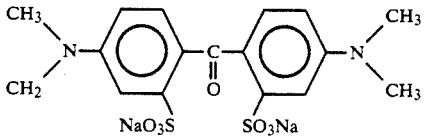

D-2

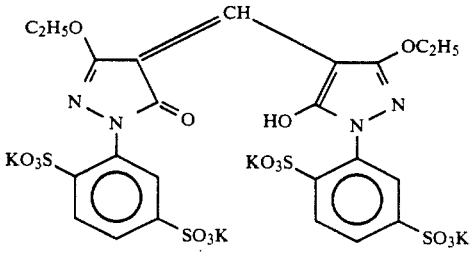

D-3

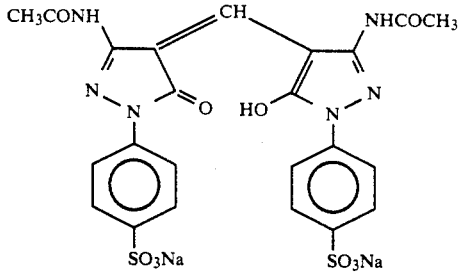

D-4

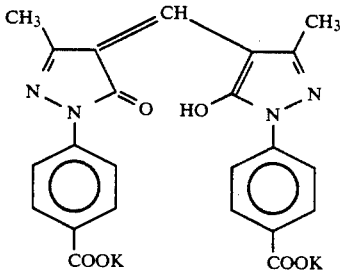

D-5

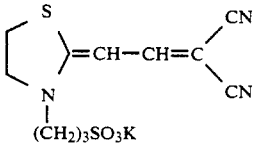

-continued

D-6

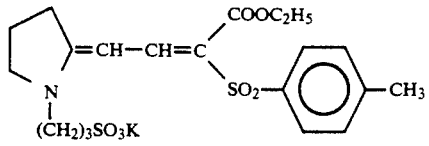

D-7

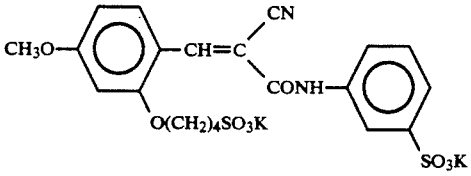

D-8

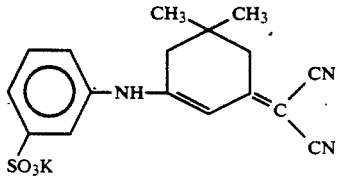

D-9

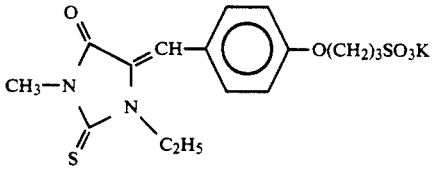

D-10

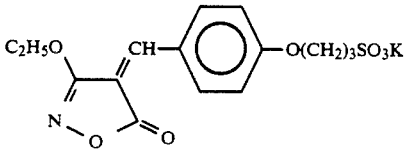

D-11

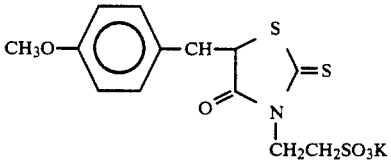

D-12

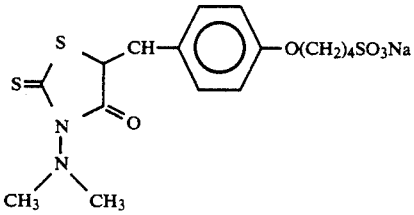

D-13

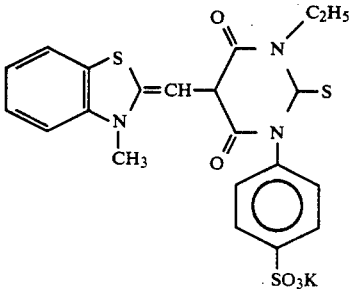

-continued

D-14

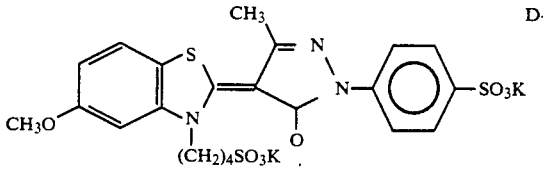

D-15

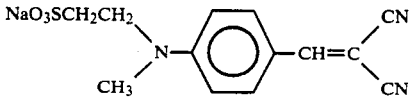

D-16

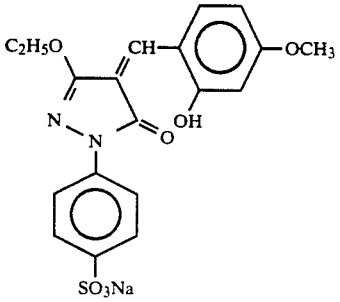

D-17

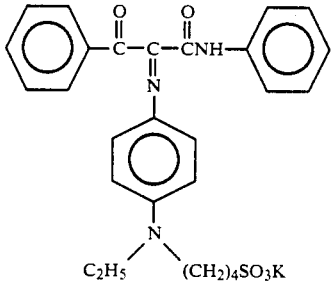

D-18

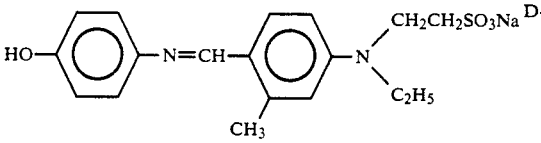

D-19

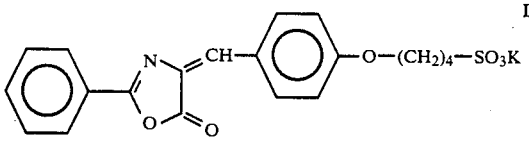

D-20

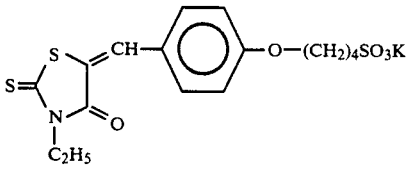

D-21

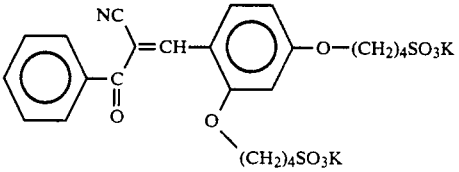

-continued

D-22

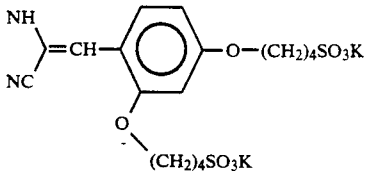

D-23

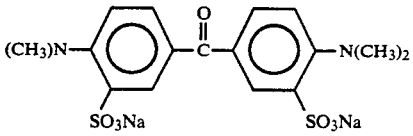

D-24

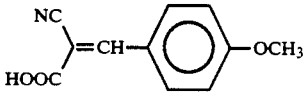

D-25

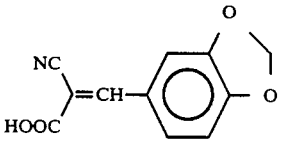

D-26

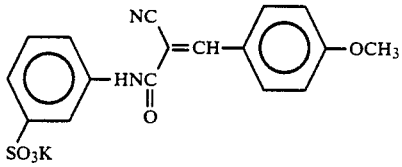

D-27

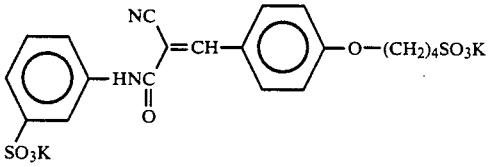

The photographic material of the present invention may contain various additives for the purpose of preventing fog, and for stabilizing photographic performance, during the manufacturing process of the photosensitive material, storage, or photographic processing thereof. Namely, many known compounds can be added to prevent fog or as a stabilizing agent, such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, such as, for example, oxazolinthione; azaindenes, for example, triazaindenes, tetraazaindenes (in particular, 4-hydroxy-substituted (1,3,3a,7)tetraazaindenes), pentaazaindenes, etc.; benzenethiosulfonic acid, benzenesulfinic acid, benzenesulfonic acid amide, hydroquinone derivatives, etc. Preferred among these are nitroindazoles (for example, 5-nitroindazole), and hydroquinone derivatives (for example, hydroquinone, methylhydroquinone). Furthermore, the above described compounds other than benzotriazoles can be contained in the processing solutions. Depending on whether they are present in the sensitizer or in the processing solution, benzotriazoles have a different effect on image quality. When present in the processing solution, image quality is impaired, but when present in the photosensitive material, benzotriazoles have practically no effect on image quality, but rather suppress fog.

The above various additives such as stabilizing agent and antifoggant can be used in an amount of from 0.1 mg to 200 mg/m$^2$, preferably from 1 mg to 150 mg/m$^2$.

The photographic material of the present invention can contain inorganic or organic hardeners in the photographic emulsion layers and other hydrophilic colloid layers. For example, active vinyl compounds (1,3,5-triacryloylhexahydro-s-triazine, 1,3-vinylsulfonyl-2-propanol), active halogen compounds (2,4-dichloro-6-hydroxy-s-triazine, etc.), mucohalogen acids, etc., can be used alone or in combination. Among these, the active vinyl compounds disclosed in JP-A-53-41221, JP-A-53-57257, JP-A-59-162546, and JP-A-60-80846, and the active halogen compounds disclosed in U.S. Pat. No. 3,325,287 are preferred.

The photosensitive emulsion layers or other hydrophilic colloid layers of photographic material for use in the present invention may contain various surfactants for various purposes, such as coating aids, prevention of static, improvement of slipperiness, emulsion dispersion, adhesion prevention and improvement of photographic properties (for example, development acceleration, contrast enhancement, and sensitization).

In particular, the polyalkylene oxides of molecular weight 600 or more, as disclosed in JP-B-58-9412, are preferred for use in the present invention.

When antistatic agents are used in the present invention, the fluorine-containing surfactants (for example, as disclosed in U.S. Pat. No. 4,201,586 and JP-A-60-80849) are particularly preferred.

To improve dimensional stability, etc., water-soluble or sparingly soluble synthetic polymer dispersions may be included in the photographic material for use in the present invention. For example, polymers composed of monomer components such as alkyl (meth)acrylates, alkoxyalkyl (meth)acrylates, glycidyl (meth)acrylates and the like, alone or in combination, or polymers composed of the above monomer components and acrylic acid and methacrylic acid as monomer components can be used.

Hydroquinone derivatives which release development inhibitors corresponding to the developed image density (so-called DIR-hydroquinone) may be contained in the hydrophilic colloid layers other than the photosensitive emulsion layers of the photographic material of the present invention.

The silver halide emulsion layers and other layers of the photographic material of the present invention preferably contain compounds which possess acid groups. Useful compounds which possess acid groups include salicylic acid, acetic acid, ascorbic acid and the like organic acids, and polymers or copolymers having repeating units derived from acrylic acid, maleic acid, phthalic acid, and the like acid monomers. Relating to these compounds, reference can be made to JP-A-61-228437, JP-A-62-25745 and JP-A-62-55642. Particularly preferred among these compounds are ascorbic acid as a low molecular weight compound, and as a high molecular weight compound, an aqueous latex of a copolymer consisting of repeating units derived from acid monomers such as acrylic acid and crosslinkable monomers having two or more unsaturated groups, such as divinylbenzene.

As the binder or protective colloid for use in the photographic material, gelatin and other hydrophilic synthetic macromolecules are advantageously used. The gelatin includes lime-treated gelatin, acid-treated gelatin, derivative gelatin and the like. Specifically, the binders are disclosed in *Research Disclosure,* Vol. 176, No. 17643 (December, 1978), section IX.

Apart from the silver halide emulsion layers, surface protective layers, intermediate layers, filter layers, antihalation layers and the like hydrophilic colloid layers can be disposed in the photographic material for use in the present invention.

Furthermore, one or more back surface layers (hereinafter, "back layers") can be established, with the objective of discrimination of the two sides of the support, imparting curling characteristics, halation prevention, etc., on the photographic material for use in the present invention. Particularly from the aspect of adhesion resistance, a matting agent of large, comparatively uniform grain size is preferably contained in the back layer for use in the present invention. Preferably the uniform grain size is 1.0 μm to 10 μm, particularly preferably, 2.0 μm to 5.0 μm.

Furthermore, the surface protective layers can contain as a matting agent, polymethyl methacrylate homopolymer, copolymers of methyl methacrylate and methacrylic acid, magnesium oxide. As a lubricant, the silicone compounds disclosed in U.S. Pat. Nos. 3,489,576 and 4,047,958, and the colloidal silica disclosed in JP-B-56-23139, paraffin wax, higher fatty acid esters, starch, etc., can be used.

Furthermore, trimethylolpropane, pentanedione, butanedione, ethylene glycol, glycerin and the like polyols can be used as plasticizers in the hydrophilic colloid layers of the photographic material of the present invention.

To obtain the photographic characteristics of supercontrast and high sensitivity using the silver halide photographic material of the present invention, it is not necessary to use the prior art infectious developers or the high alkali developers having a pH of about 13 as disclosed in U.S. Pat. No. 2,419,975; rather, stable developers can be used.

Namely, for developing the silver halide photographic material of the present invention, the developer contains 0.20 mol/liter or more of sulfite ion as a preservative, and has a pH of preferably 11.2 or less. More preferably, the pH is 11.0 to 9.5.

When the pH of the developer is higher than 11.2, the pH is sensitive to $CO_2$ in air, and the developer tends to be oxidized and colored. At a pH below 9.5, contrast becomes poor, and clear image quality is not obtained.

There is no particular limitation on the developing agent for use in the developer in accordance with the present invention, but from the standpoint of readily obtaining good dot quality, the developer preferably includes dihydroxybenzenes; furthermore, from the standpoint of developing capacity, a combination of dihydroxybenzenes and 1-phenyl-3-pyrazolidones, or a combination of dihydroxybenzenes and p-aminophenols, is preferred.

The dihydroxybenzene developing agent for use in the present invention includes hydroquinone, chlorohydroquinone, isopropylhydroquinone, methylhydroquinones and the like; hydroquinone being particularly preferred.

The 1-phenyl-3-pyrazolidones and derivatives thereof for use as the developing agent in the present invention include 1-phenyl-3-pyrazolidone, 1-phenyl-4,4-dimethyl-3-pyrazolidone, 1-phenyl-4-methyl-4-hydroxymethyl-3-pyrazlidone, etc.

The p-aminophenol based developing agent for use in the present invention includes N-methyl-p-aminophenol, p-aminophenol, N-(β-hydroxyethyl)-p-aminophenol, N-(4-hydroxyphenyl)glycine, etc., but N-methyl-p-aminophenol is preferred among these.

The preferred concentration of the developing agent is generally 0.05 mol/liter to 0.8 mol/liter of the developing solution. Furthermore, when a combination of dihydroxybenzenes with either 1-phenyl-3-pyrazolidone or p-aminophenols is used, 0.05 mol/liter to 0.5 mol/liter of the former, or 0.06 mol/liter or less of the latter, is the preferred concentration.

The sulfite salt used as a preservative in the developing solution of the present invention is sodium sulfite, potassium sulfite, lithium sulfite, ammonium sulfite, sodium bisulfite, potassium metabisulfite, sodium formaldehyde bisulfite, etc. The addition amount of the sulfite salt is 0.20 mol/liter or more, in particular 0.3 mol/liter or more. Addition of the sulfite salt in too great a quantity gives rise to precipitation in the developer and contamination of the solution, such that an upper limit of 1.2 mol/liter is desirable.

Known water-soluble inorganic alkali metal salts (for example, sodium hydroxide, sodium carbonate) can be used as the alkaline agent to adjust the pH.

Buffers for use in the developer of the present invention include boric acid as disclosed in JP-A-62-186259, sugars as disclosed in JP-A-60-93433 (for example, saccharose), oximes (for example, acetoxime), phenols (for example, 5-sulfosalicylic acid), tertiary phosphate salts (for example, the sodium, potassium salts), etc.; boric acid is preferred.

The buffer (preferably having an acid dissociation constant of $1\times10^{-11}$ to $3\times10^{-13}$) for the developer can be added in an amount of from 0.2 mol/liter to 1 mol/liter. The addition of a buffer has no relation to the quantity of silver or degree of blackening of the developed photographic material, and the supercontrast and sensitivity increase due to the hydrazine can be stably obtained even when an automatic developing machine is used. Moreover, the acid dissociation constant means here that all of the first, second or third dissociation constants of the compound are from $1\times10^{-11}$ to $3\times10^{-13}$.

Useful additives to the developing solution apart from the above described constituents include pH adjusting agents such as potassium hydroxide, sodium carbonate; development inhibitors such as sodium bromide, potassium bromide; organic solvents such as ethylene glycol, diethylene glycol, triethylene glycol, dimethylformamide; development accelerators such as diethanolamine, triethanolamine and the like alkanolamines, imidazole and its derivatives; antifoggants or black pepper preventing agents such as 1-phenyl-5-mercaptotetrazole and the like mercapto compounds, 5-nitro-indazole and the like indazole compounds; and according to requirements, toners, surfactants, defoaming agents, water softeners, hardeners, etc.

The fixer for use in the present invention contains a thiosulfate such as sodium thiosulfate or ammonium thiosulfate; ammonium thiosulfate is preferred from the standpoint of fixing speed. The addition amount of the fixing agent varies depending on the application, but is generally about 0.1 to about 5 mol/liter of the fixing solution.

Acid hardeners for use in the fixing solution of the present invention include water-soluble aluminum salts, chromium salts, and also trivalent iron compounds. An ethylenediaminetetraacetic acid complex may be used as an acidifying agent. The preferred compounds are water-soluble aluminum compounds, e.g., aluminum chloride, aluminum sulfate, potassium alum, etc. The addition amount is preferably 0.01 mol/liter to 0.2 mol/liter, more preferably 0.03 to 0.08 mol/liter.

As the above noted dibasic acids, tartaric acid or derivatives thereof, or citric acid and derivatives thereof, can be used alone or in combination. The above noted compounds are effective at an addition amount of from 0.005 mol or more per 1 liter of fixing solution, and are particularly effective at 0.01 mol/liter to 0.03 mol/liter.

Specifically, useful dibasic acids include tartaric acid, potassium tartrate, sodium tartrate, potassium hydrogen tartrate, sodium hydrogen tartrate, potassium sodium tartrate, ammonium tartrate, ammonium potassium tartrate, aluminum potassium tartrate, antimonium potassium tartrate, antimonium sodium tartrate, lithium hydrogen tartrate, lithium tartrate, magnesium hydrogen tartrate, potassium borotartrate, lithium potassium tartrate, etc.

Examples of the citric acid or derivatives thereof effective in the present invention are citric acid, sodium citrate, potassium citrate, lithium citrate, ammonium citrate, etc.

The fixing solution can optionally contain a preservative (e.g., sulfite salts, bisulfite salts), pH buffers (e.g., acetic acid, boric acid), pH adjustment agents (e.g., sulfuric acid), chelating agents (described above). Here, the pH buffer is added in an amount of from 10 to 40 g/liter, more preferably 18 to 25 g/liter, because the pH of the developer is relatively high.

The fixing temperature and time are the same as in the case of development, preferably about 20° C. to about 50° C. for 10 seconds to 1 minute.

The present invention is further described by reference to the following examples.

COMPARATIVE EXAMPLE

A silver iodobromide emulsion was prepared by the controlled double jet method in an aqueous gelatin solution maintained at 55° C. in the presence of ammonia, and was cubic monodisperse with a grain size of 0.30 μm, (coefficient of variation: 12%, silver iodide: 0.5 mol %, iodine distribution: uniform). To this silver iodobromide emulsion, $K_3IrCl_6$ was added in an amount of $5\times10^{-7}$ mol/Ag.

Desalting of this emulsion was performed by the floccuration method, after which it was maintained at 50° C. As a sensitizing dye, $5\times10^{-4}$ mol/mol Ag of the compound described below, and $10^{-3}$ mol/mol Ag of potassium iodide solution were added thereto and, after 15 minutes, $4.5\times10^{-4}$ mol/Ag of 4-hydroxy-6-methyl-1,3,3a,7-tetraazaindene was added to the mixture, and the temperature was then lowered. The resulting emulsion was designated as Emulsion a.

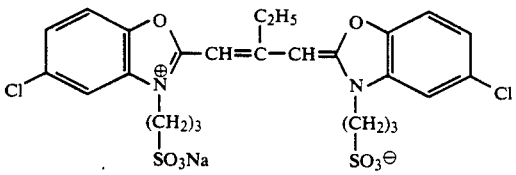

To this Emulsion a were added a hydrazine compound (I-15) and a nucleation promoter (II-8) and 5-methylbenzotriazole in amounts of $2\times10^{-4}$ mol/Ag, $8.6\times10^{-3}$ mol/Ag, $3\times10^{-3}$ mol/Ag, respectively. In addition, polyethyl acrylate and 1,3-divinylsulfonyl-2-propanol as a hardening agent were added in amounts of 200 mg/m$^2$ and 80 mg/m$^2$, respectively, and the emulsion was coated at 4.0 g/m$^2$ onto a polyethylene terephthalate film. On the silver halide emulsion layer were simultaneously coated, as a protective layer, 1.2 g/m$^2$ of gelatin, 40 mg/m$^2$ of $SiO_2$ of particle size about 3 μm and irregular form, 0.1 g/m$^2$ of methanol silica, and, as a coating auxiliary, 0.4 mg/m$^2$ of a fluorinated surfactant having the structure shown below:

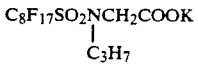

and sodium dodecylbenzenesulfonate. The resulting material was designated as Sensitive Material No. 1 (Comparative Example 1).

Furthermore, a back layer having a composition shown below was coated onto Photosensitive Material No. 1.

| Composition of Back Layer | |
|---|---|
| Gelatin | 4 g/m$^2$ |
| Matting agent, polymethyl methacrylate (particle size: 3.0 to 4.0 μm) | 10 mg/m$^2$ |
| Latex, polyethyl acrylate | 2 g/m$^2$ |
| Surfactant, sodium p-dodecylbenzenesulfonate | 40 mg/m$^2$ |
| Fluorinated surfactant | 5 mg/m$^2$ |
| $C_8F_{17}SO_2N(C_3H_7)CH_2COOK$ | |
| Gelatin hardening agent | 110 mg/m$^2$ |
| $(CH_2{=}CHSO_2CH_2CONH)_2CH_2$ | |
| Dyes: Compounds of Dye (a), (b) and (c) | |
| Dye (a) | 50 mg/m$^2$ |
| Dye (b) | 100 mg/m$^2$ |
| Dye (c) | 50 mg/m$^2$ |

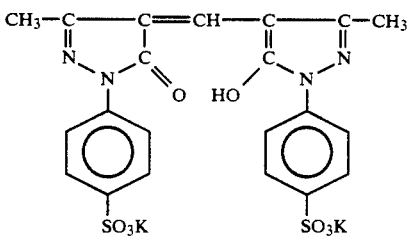

Dye (a)

-continued

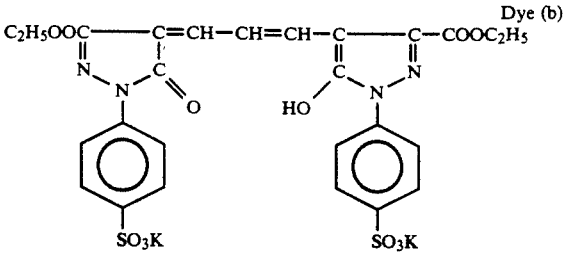

Dye (b)

To the photosensitive emulsion layer of the Sensitive Material No. 1 were added redox compounds of the present invention IV-7, IV-9, IV-16, IV-22 each in an amount of $2\times10^{-5}$ mol/m$^2$ to obtain Photosensitive Materials No. 2, No. 3, No. 4 and No. 5, respectively.

The resulting samples were exposed with a 3,200° K. tungsten light through an optical wedge and a contact screen (Fuji Photo Film Co., Ltd., 150L chain-dot type), and were developed for 30 seconds at 34° C. in the following developing solution, fixed, washed with water, and dried.

| Developing Solution | |
|---|---|
| Hydroquinone | 54 g |
| 4-Methyl-4-hydroxymethyl-1-phenyl-3-pyrazolidone | 0.42 g |
| Potassium sulfite | 90 g |
| Sodium ethylenediaminetetraacetate | 2.8 g |
| Potassium bromide | 5 g |
| 5-Methylbenzenetriazole | 0.08 g |
| 2-Mercaptobenzimidazole-5-sulfonic acid | 0.5 g |
| Boric acid | 10 g |
| (KOH added to adjust pH to 10.6) | |
| Water added to make | 1 l |

Gradation (γ) is the slope of a straight line joining the points of density 0.3 and 3.0 on the characteristic curve.

Dot gradation was represented by the following formula.

* Dot gradation = exposure quantity providing 95% of dot surface area percentage (log E 95%) − exposure quantity providing 5% of dot surface area percentage (log E 5%)

Dot quality was evaluated by naked eye in five grades. The five evaluation grades denoted quality from "5" (best) to "1" (worst). As a negative for use in making printing plates, a grade of "5" or "4" is generally adequate for use, "3" denotes a restricted level of possibility of use, and "2" and "1" are of a quality which is not useable. The results are shown in Table 1.

EXAMPLE 1

In a manner similar to Comparative Example 1, layers were coated in succession on a polyethylene terephthalate film (thickness: 150 μm) having an undercoat layer (0.5 μm) consisting of vinylidene chloride copolymer.

First Layer

Same as photosensitive emulsion layer of Comparative Example 1.

Second Layer

Gelatin (1.5 g/m$^2$).

Third Layer

Emulsion b (silver quantity: 0.4 g/m$^2$) which is the same as Emulsion a of Comparative Example 1 except for only the grain size is changed to 0.35 μm, 5-methylbenzotriazole ($5\times10^{-3}$ mol/Ag mol), 4-hydroxy-1,3,3a,7-tetraazaindene ($2\times10^{-3}$ mol/Ag mol), polyethyl acrylate (30 wt % of gelatin), 1,3-divinylsulfonyl-2-propanol (2% of gelatin) and redox compounds of the present invention as indicated in Table 1 ($2\times10^{-5}$ mol/m$^2$).

Fourth Layer

Same as protective layer of Comparative Example 1.

TABLE 1

| | Photosensitive Material No. | Redox Compound | | Photographic Properties | | |
|---|---|---|---|---|---|---|
| | | Type | Layer to Which Added | $\bar{G}$ | Dot | Dot Quality |
| Comparative Example | 1 | None | | 12.0 | 1.40 | 5 |
| Comparative Example | 2 | Compound IV-7 | Photosensitive Emulsion Layer | 6.0 | 1.40 | 3 |
| Comparative Example | 3 | Compound IV-9 | Photosensitive Emulsion Layer | 6.5 | 1.38 | " |
| Comparative Example | 4 | Compound IV-16 | Photosensitive Emulsion Layer | 7.0 | 1.41 | " |
| Comparative Example | 5 | Compound IV-22 | Photosensitive Emulsion Layer | 6.5 | 1.41 | " |
| Invention | 6 | Compound IV-7 | Third Layer | 12.2 | 1.48 | 5 |
| " | 7 | Compound IV-9 | " | 12.0 | 1.50 | " |
| " | 8 | Compound IV-16 | " | 12.3 | 1.48 | " |
| " | 9 | Compound IV-22 | " | 12.0 | 1.47 | " |
| Comparative Example | 10 | None | " | 12.0 | 1.40 | " |

It is clearly seen that the sensitive materials of the present invention provided markedly wider dot gradation as compared to the comparative examples. As against the marked loss of contrast shown by a G value of less than 8 for Comparative Examples 2 to 5, the samples of the present invention maintained high contrast. Also, the dot gradation was wide and the dot quality was good.

While the invention has been described in detail and with reference to specific embodiments thereof, it will be apparent to one skilled in the art that various changes and modifications can be made therein without departing from the spirit and scope thereof.

What is claimed is:

1. A method for forming images having a contrast of greater than G 8 which comprises developing an imagewise exposed silver halide photographic material with a developing solution having a pH of 11.2 or less, said silver halide photographic material comprising a support having thereon a hydrophilic colloid layer containing a redox compound which releases a development inhibitor upon oxidation and at least one photosensitive silver halide emulsion layer containing at least one hydrazine derivative represented by formula (I), and said at least one photosensitive silver halide emulsion layer containing at least one hydrazine derivative represented by formula (I) being different from said hydrophilic colloid layer containing a redox compound:

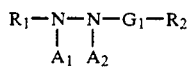

(I)

wherein $R_1$ represents an aliphatic group or an aromatic group; $R_2$ represents a hydrogen atom, an alkyl group, an aryl group, an alkoxy group, an aryloxy group, an amino group or a hydrazino group; $G_1$ represents a

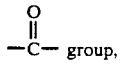

an —$SO_2$ group, an —SO— group,

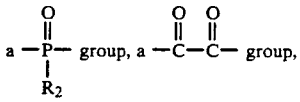

a thiocarbonyl group, or an iminomethylene group; $A_1$ and $A_2$ each represents a hydrogen atom, or one of $A_1$ and $A_2$ represents a hydrogen atom and the other represents an alkylsulfonyl group, or an arylsulfonyl group, or an acyl group.

2. A method for forming images as in claim 1, wherein said hydrophilic colloid layer or said at least one silver halide emulsion layer contains at least one compound selected from compounds represented by formulae (II) and (III):

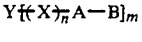

(II)

wherein Y represents a group which adsorbs onto silver halide; X represents a divalent linking group; A represents a divalent linking group; B represents an amino group, an ammonium group or a nitrogen-containing heterocyclic group; m represents 1, 2 or 3; n represents 0 or 1;

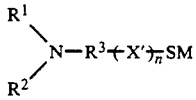

(III)

wherein $R^1$ and $R^2$ each represents a hydrogen atom or an aliphatic residue;

$R^1$ and $R^2$ may be bonded together to form a ring;

$R^3$ represents a divalent aliphatic group;

X′ represents a divalent 5- or 6-membered heterocyclic group containing a nitrogen atom, an oxygen atom or a sulfur atom;

n represents 0 or 1;

M represents a hydrogen atom, an alkali metal, an alkaline earth metal, a quaternary ammonium group, a quaternary phosphonium group, or an amidino group.

3. A method for forming images as in claim 1, wherein the hydrazine derivative represented by formula (I) is contained in the at least one photosensitive silver halide emulsion layer in an amount of from $1\times10^{-6}$ to $5\times10^{-2}$ mol per mol of silver halide contained in the same layer.

4. A method for forming images as in claim 1, wherein the hydrazine derivative represented by formula (I) is contained in the at least one photosensitive silver halide emulsion layer in an amount of from $1\times10^{-5}$ to $2\times10^{-2}$ mol per mol of silver halide contained in the same layer.

5. A method for forming images as in claim 2, wherein said compound represented by formula (II) is represented by formula (II-a):

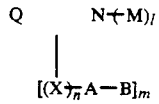

(II-a)

wherein l represents 0 or 1, m represents 1, 2 or 3, and n represents 0 or 1; $[(X_n—A—B]_m$ has the same meaning as in formula (II); Q represents an atomic group necessary for forming a 5- or 6-membered heterocyclic ring.

6. A method for forming images as in claim 2, wherein the compound represented by formulae (II) and (III) is contained in an amount of from $1.0\times10^{-3}$ to 0.5 g/m$^2$ of the photographic material.

7. A method for forming images as in claim 1, wherein the hydrophilic colloid layer containing the redox compound is arranged above the photosensitive silver halide emulsion layer containing the hydrazine derivative represented by formula (I).

8. A method for forming images as in claim 1, wherein the photographic material further contains a dye having an absorption peak at 300 to 420 nm.

9. A method for forming images as in claim 1, wherein the developing solution has a pH of from 11.0 to 9.5.

10. A method for forming images as in claim 1, wherein the developing solution contains a sulfite salt in an amount of 0.20 mol/liter or more.

* * * * *